US010898001B2

(12) United States Patent
Masunaga et al.

(10) Patent No.: US 10,898,001 B2
(45) Date of Patent: Jan. 26, 2021

(54) ARMREST AND CHAIR

(71) Applicant: OKAMURA CORPORATION, Yokohama (JP)

(72) Inventors: Hiroshi Masunaga, Yokohama (JP); Ryo Igarashi, Yokohama (JP); Syouichi Izawa, Yokohama (JP)

(73) Assignee: OKAMURA CORPORATION, Yokohama (JP)

( * ) Notice: Subject to any disclaimer, the term of this patent is extended or adjusted under 35 U.S.C. 154(b) by 0 days.

(21) Appl. No.: 16/307,855

(22) PCT Filed: Jun. 8, 2017

(86) PCT No.: PCT/JP2017/021366
§ 371 (c)(1),
(2) Date: Dec. 6, 2018

(87) PCT Pub. No.: WO2017/213236
PCT Pub. Date: Dec. 14, 2017

(65) Prior Publication Data

US 2019/0298071 A1 Oct. 3, 2019

(30) Foreign Application Priority Data

Jun. 10, 2016 (JP) ..... 2016-116276
Jun. 10, 2016 (JP) ..... 2016-116565

(51) Int. Cl.
*A47C 7/54* (2006.01)
*A47C 1/03* (2006.01)

(52) U.S. Cl.
CPC ..... *A47C 7/543* (2013.01); *A47C 1/0307* (2018.08); *A47C 7/541* (2018.08); *A47C 1/0303* (2018.08)

(58) Field of Classification Search
CPC ..... A47C 1/03; A47C 1/0303; A47C 1/0305; A47C 1/0307; A47C 7/54; A47C 7/541; A47C 7/543; A47C 7/546
See application file for complete search history.

(56) References Cited

U.S. PATENT DOCUMENTS 5,439,268 A * 8/1995 Dozsa-Farkas ..... A47C 1/03 297/411.35
7,201,450 B1 * 4/2007 Chen ..... A47C 1/0308 297/411.37

(Continued)

FOREIGN PATENT DOCUMENTS

CA 2229177 A1 * 8/1999 ..... A47C 1/03
CA 2472070 A1 * 8/2003 ..... A47C 1/03255

(Continued)

OTHER PUBLICATIONS

International Search Report for PCT/JP2017/021366 dated Aug. 8, 2017.

(Continued)

*Primary Examiner* — Ryan D Kwiecinski
(74) *Attorney, Agent, or Firm* — Nixon Peabody LLP; Jeffrey L. Costellia

(57) ABSTRACT

An armrest (8, 208) and a chair (100, 200) according to the present invention are provided with: an armrest body (8*b*, 208*b*) which is a movable member including a placing surface for supporting a limb of a seated person, and which is supported by a support rod (8*a*, 208*a*) from below so as to be movable in a horizontal direction; and a through-space (S, 200S) which is a guide portion indicating the position to be touched by the seated person when moving the armrest body (8*b*, 208*b*).

8 Claims, 13 Drawing Sheets

(56) References Cited

U.S. PATENT DOCUMENTS

| | | | | |
|---|---|---|---|---|
| 7,367,628 | B1 * | 5/2008 | Tsai | A47C 1/03 297/411.35 |
| 7,387,341 | B1 * | 6/2008 | Tsai | A47C 1/0307 297/411.35 |
| 7,815,259 | B2 * | 10/2010 | Fookes | A47C 1/0305 297/411.35 |
| 8,226,171 | B2 * | 7/2012 | Fang | A47C 1/03 297/411.35 |
| 8,403,417 | B2 * | 3/2013 | Huang | A47C 1/0307 297/411.35 |
| 8,474,914 | B2 * | 7/2013 | Chen | A47C 1/03 297/411.37 |
| 8,678,503 | B2 * | 3/2014 | Machael | A47C 1/03 297/411.37 |
| 9,084,487 | B1 * | 7/2015 | Su | A47C 1/0308 |
| 9,901,175 | B2 * | 2/2018 | Chen | A47C 1/0307 |
| 2003/0030317 | A1 * | 2/2003 | Chen | A47C 1/03 297/411.35 |
| 2005/0146192 | A1 * | 7/2005 | Trego | A47C 1/0307 297/411.37 |
| 2006/0250018 | A1 * | 11/2006 | Tsai | A47C 1/0307 297/411.36 |
| 2009/0033139 | A1 * | 2/2009 | Machael | A47C 1/0308 297/411.37 |
| 2011/0248542 | A1 * | 10/2011 | Tsai | A47C 1/0305 297/411.36 |
| 2012/0025584 | A1 * | 2/2012 | Chen | A47C 1/0307 297/411.37 |
| 2012/0175933 | A1 * | 7/2012 | Tsai | B60N 2/77 297/411.36 |
| 2013/0264855 | A1 * | 10/2013 | Huang | A47C 1/0305 297/411.35 |
| 2014/0183922 | A1 * | 7/2014 | Cvek | A47C 1/03 297/411.36 |
| 2016/0316917 | A1 * | 11/2016 | Qi | A47C 1/03 |
| 2019/0174921 | A1 * | 6/2019 | Chen | A47C 1/03 |

FOREIGN PATENT DOCUMENTS

| | | | | |
|---|---|---|---|---|
| CN | 2617248 | | 5/2004 | |
| CN | 203302679 | | 11/2013 | |
| DE | 202011050890 | U1 * | 9/2011 | A47C 1/0305 |
| JP | 2000-270966 | | 10/2000 | |
| JP | 2013-233166 | | 11/2000 | |
| JP | 2002051870 | A * | 2/2002 | A47C 1/03 |
| JP | 2003-126171 | | 5/2003 | |
| JP | 2004-049690 | | 2/2004 | |
| JP | 2004113502 | A * | 4/2004 | A47C 1/03 |
| JP | 2007-130363 | | 5/2007 | |
| JP | 2013248374 | A * | 12/2013 | A47C 1/0308 |
| JP | 5879394 | | 3/2016 | |
| WO | WO-2008112920 | A1 * | 9/2008 | A47C 1/0307 |
| WO | WO-2012062032 | A1 * | 5/2012 | A47C 1/03 |

OTHER PUBLICATIONS

Extended European Search Report in European Application No. 17810409.7.

* cited by examiner

ARMREST AND CHAIR

TECHNICAL FIELD

The present invention relates to an armrest and a chair.

Priority is claimed on Japanese Patent Application No. 2016-116276 and Japanese Patent Application No. 2016-116565 both filed Jun. 10, 2016, the contents of which are incorporated herein by reference.

BACKGROUND

As shown in Patent Documents 1 and 2, for example, there is a case in which an armrest capable of allowing adjustment of a horizontal position of an elbow pad can be provided in a chair. This armrest capable of adjusting the position of an elbow pad has, for example, a movable member (an elbow pad) which directly supports a seated person's arm or the like, and a support member which supports the movable member from below. In the configurations disclosed in Patent Documents 1 and 2, guide portions are provided at both end portions of the support member in a longitudinal direction of the chair, so that movement of the movable member can be performed stably.

In addition, the armrest disclosed in Patent Documents 1 and 2 may have, for example, an upper layer member (an elbow pad) which directly supports the seated person's arm or the like, and a lower layer member which supports the upper layer member from below. In the configurations disclosed in Patent Documents 1 and 2, guide portions are provided at both end portions of the lower layer member in a longitudinal direction of the chair, so that the movement of the upper layer member can be performed stably.

DOCUMENT OF RELATED ART

Patent Document

[Patent Document 1] Specification of U.S. Pat. No. 7,815,259

[Patent Document 2] Japanese Patent Granted Publication No. 5879394

SUMMARY

Technical Problem

In the configurations disclosed in Patent Documents 1 and 2, however, it is impossible to predict which portion of the movable member the seated person will touch when moving the movable member. For this reason, in the case of touching an unexpected portion to move the movable member, there is a possibility that the support member may touch the seated person's fingertips or the like, thereby making the seated person feel uncomfortable.

The present invention has been made in view of the problems described above, and it is an object of the present invention in prevent problems in which when moving a movable member in an armrest capable of moving the movable member in a horizontal direction with respect to a support member, a seated person's fingertip touches an unexpected portion thereof and makes the seated person feel uncomfortable.

In addition, according to the configurations disclosed in Patent Documents 1 and 2, the upper layer member slides with respect to the lower layer member with the upper layer member and the lower layer member in surface contact. For this reason, when the seated person adjusts a position of the upper layer member, it is necessary to adjust it while holding a side surface of the upper layer member or pressing and holding the seated person's hand against an upper surface thereof. However, there may be a case in which it is difficult to secure a wide side surface for the upper layer member due to design restrictions and the like. In addition, in the case where the seated person tries to move the upper layer member while pressing and contacting the seated person's hand on the upper surface of the upper layer member, the seated person's hand may easily slip with respect to the upper layer member. As such, the configurations disclosed in Patent Documents 1 and 2 have poor operability in the case of moving the upper member of the armrest in the horizontal direction.

The present invention has been made in view of the problems described above, and it is an object of the present invention to improve operability in moving an upper layer member in an armrest in which the upper layer member is movable in the horizontal direction with respect to a lower layer member.

Solution to Problem

A first invention for solving the problems is an armrest for being provided on a chair, including: a support member; a movable member which includes a placing surface for supporting a limb of a seated person and is supported by the support member from below to be movable in a horizontal direction; and a guide portion which indicates a position where the seated person touches when moving the movable member.

According to the present invention, the position where the seated person touches the moving member is indicated by the guide portion. Therefore, since the hand of the seated person can be directed to a position suitable for horizontally moving the moving member with respect to the support member, it is possible to prevent the seated person from moving the movable member in a state where the seated person can touch an unexpected portion.

A second invention is that in the first invention, the guide portion is formed of a recessed portion, the recessed portion is provided on an outer side surface of the movable member and is recessed in a width direction of the chair.

According to the present invention, since the recessed portion serves as the guide portion, the seated person can confirm the position of a through-space S based on the feel of the fingertip or the like even if the seated person does continuously directly observe the through-space. Therefore, it is possible to more reliably guide the seated person to the through-space S.

A third invention is that in the second invention, the recessed portion penetrates from one side to the other side of the movable member in the width direction of the chair.

According to the present invention, the seated person can insert fingers into the recessed portion from both sides of the armrest in the width direction. For this reason, for example, since the thumb of the seated person can be inserted into the recessed portion from one side of the armrest in the width direction, and the fingers other than the thumb of the seated person can be inserted into the recessed portion from the other side of the armrest in the width direction, it is possible to stably hold the movable member. Further, since there is no member that prevents the fingers from being inserted into the recessed portion, the lingers of the seated person can be inserted deeply into the recessed portion, thereby making it possible to secure a large contact area between the hand of the seated person and the movable member. Therefore, according to the present invention, it is possible to stably hold the movable member.

A fourth invention is that in the first invention, the guide portion is disposed above a space between the movable member and the support member.

In general, when the seated person grasps the movable member, the seated person touches the movable member from above. Here, according to the present invention, the hand of the seated person reaches the guide portion before reaching between the movable member and the support member. Therefore, it is possible to inhibit the hand of the seated person approaching the support member, thereby more reliably preventing touching of the fingertip or the like of the seated person on an unexpected portion when the movable member is moved.

A fifth invention is an armrest for being provided in a chair, wherein a movable member includes an upper layer member and a lower layer member, the lower layer member is supported by a support member from below, and the upper layer member is supported by the lower layer member from below to be movable in a horizontal direction, forms a finger-inserting space between itself and at least a part of the lower layer member, and is disposed at least partially facing the part of the lower layer member.

According to the present invention, the finger-inserting space is formed between the upper layer member and the lower layer member. For this reason, it is possible for the seated person on the chair to insert his or her finger into the finger-inserting space and grasp the upper layer member to move it in the horizontal direction. In this case, since the seated person can hold the upper layer member from above and below, for example, by bringing a palm of the seated person's hand into contact with an upper surface of the upper layer member and inserting fingertips into the finger-inserting space, the seated person can stably hold the upper layer member. Therefore, according to the present invention, the upper layer member can be moved in a very stable state as compared with the case where the finger-inserting space is not provided.

In addition, according to the present invention, the upper layer member can be stably moved without the side surface of the upper layer member being widened. For this reason, it is also possible to make the upper layer member in a thin shape. This makes it possible to increase the flexibility of the armrest design.

A sixth invention is that in the fifth invention, the armrest includes a spacer member which separates a part of the lower layer member from a part of the upper layer member to form the finger-inserting space.

According to the present invention, a part of the lower layer member is separated from a part of the upper layer member by the spacer member, and the space thus formed is defined as the finger-inserting space. For this reason, it is possible to easily secure the finger-inserting space due to the spacer member. In addition, due to the presence of the spacer member, the seated person can also find the position of the finger-inserting space using the spacer member as a mark, so that the seated person can easily find the position of the finger inserting space.

A seventh invention is that in the fifth or sixth invention, the armrest includes a guide element which guides movement of the upper layer member in the horizontal direction with respect to the lower layer member, wherein the guide element includes: a guide groove which is provided on either one of the upper layer member and the lower layer member and is formed in a moving direction of the upper layer member; and a guide protruding portion which is provided on the other of the upper layer member and the lower layer member and is slidably engaged with the guide groove.

According to the present invention, the movement of the upper layer member with respect to the lower layer member is guided by sliding the guide protruding portion along the guide groove. Therefore, it is possible to stably move the upper layer member in the horizontal direction.

An eighth invention is that in the fifth invention, the finger-inserting space penetrates from one side to the other side of the armrest in a width direction of the chair.

According to the present invention, the seated person can insert fingers into the finger-inserting space from both sides of the armrest in the width direction. For this reason, for example, since the thumb of the seated person can be inserted into the finger-inserting space from one side of the armrest in the width direction, and the fingers other than the thumb of the seated person can be inserted into the finger-inserting space from the other side of the armrest in the width direction, it is possible to hold the upper layer member more stably. Further, since there is no member that prevents the fingers from being inserted into the finger-inserting space, the fingers of the seated person can be inserted deeply into the finger-inserting space, thereby making it possible to hold the upper member more stably.

A ninth invention is a chair including the armrest according to any one of the first to eight inventions.

The chair of the present invention has the armrest of the present invention described above. Therefore, it is possible to prevent a fingertip or the like of the seated person from touching an unexpected portion and causing an uncomfortable feeling of the seated person, in the case of moving the movable member.

The chair of the present invention has the armrest of the present invention described above. Therefore, it is possible to improve the operability in moving the upper layer member in the horizontal direction with respect to the lower layer member in the armrest.

Effects

According to the present invention, it is possible to prevent the seated person from moving the movable member in a state where the seated person touches an unexpected portion, thereby making it possible to suppress an uncomfortable feeling given to the seated person when a fingertip or the like of the seated person touches an unexpected portion in the case of moving the movable member.

According to the present invention, it is possible to move the upper layer member in an extremely stable state and in the armrest in which the upper layer member is movable in the horizontal direction with respect to the lower layer member, the operability when moving the upper layer member can be improved.

DESCRIPTION OF EMBODIMENTS

First Embodiment

Hereinafter, a first embodiment of an armrest and a chair according to the present invention will be described with reference to the drawings.

Also, in the following drawings, the scales of respective members may be appropriately changed in order to make each member have a recognizable size.

Figure 1:
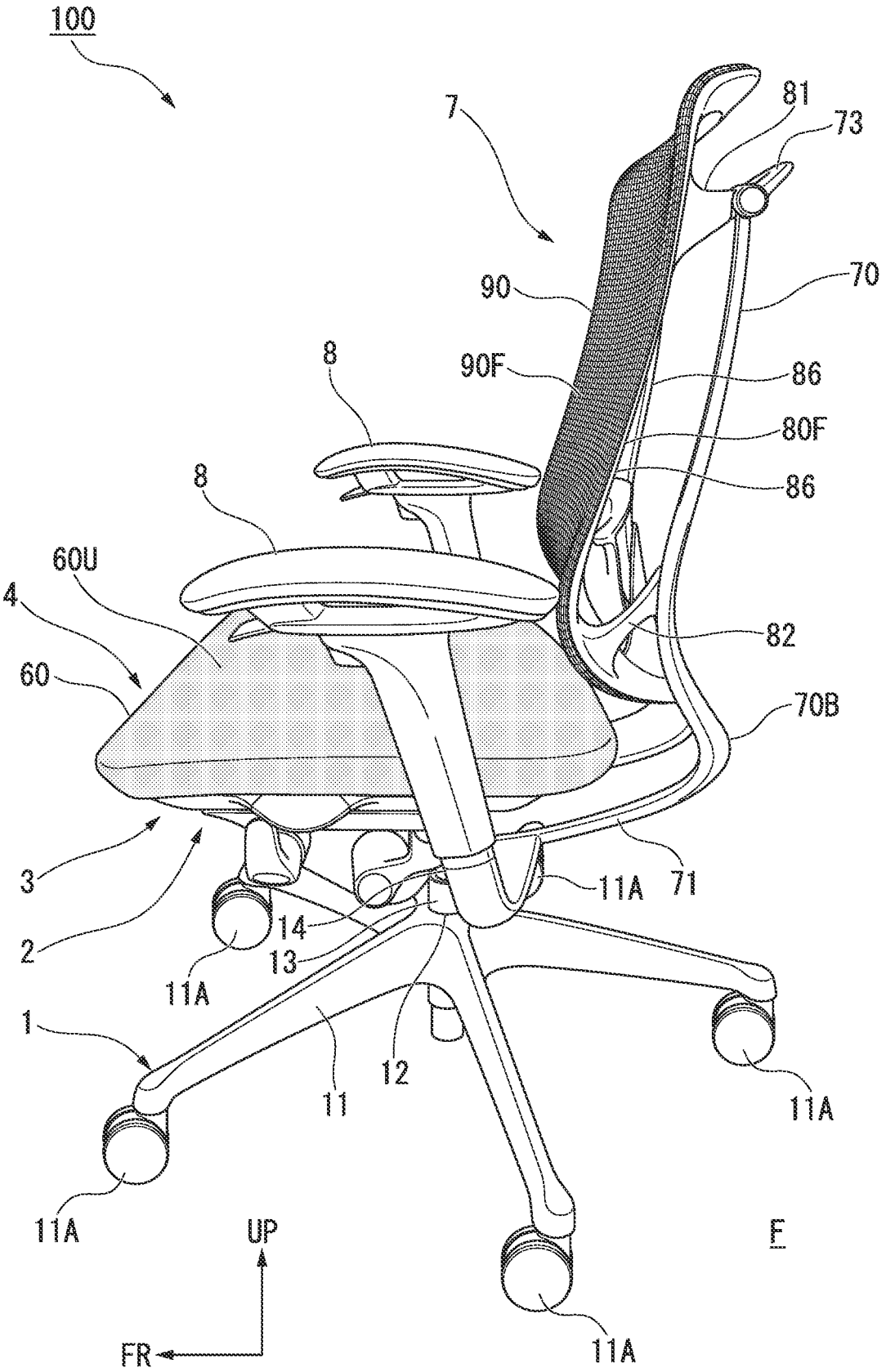
FIG. 1 is a side perspective view of a chair according to a first embodiment of the present invention.
Figure 2:
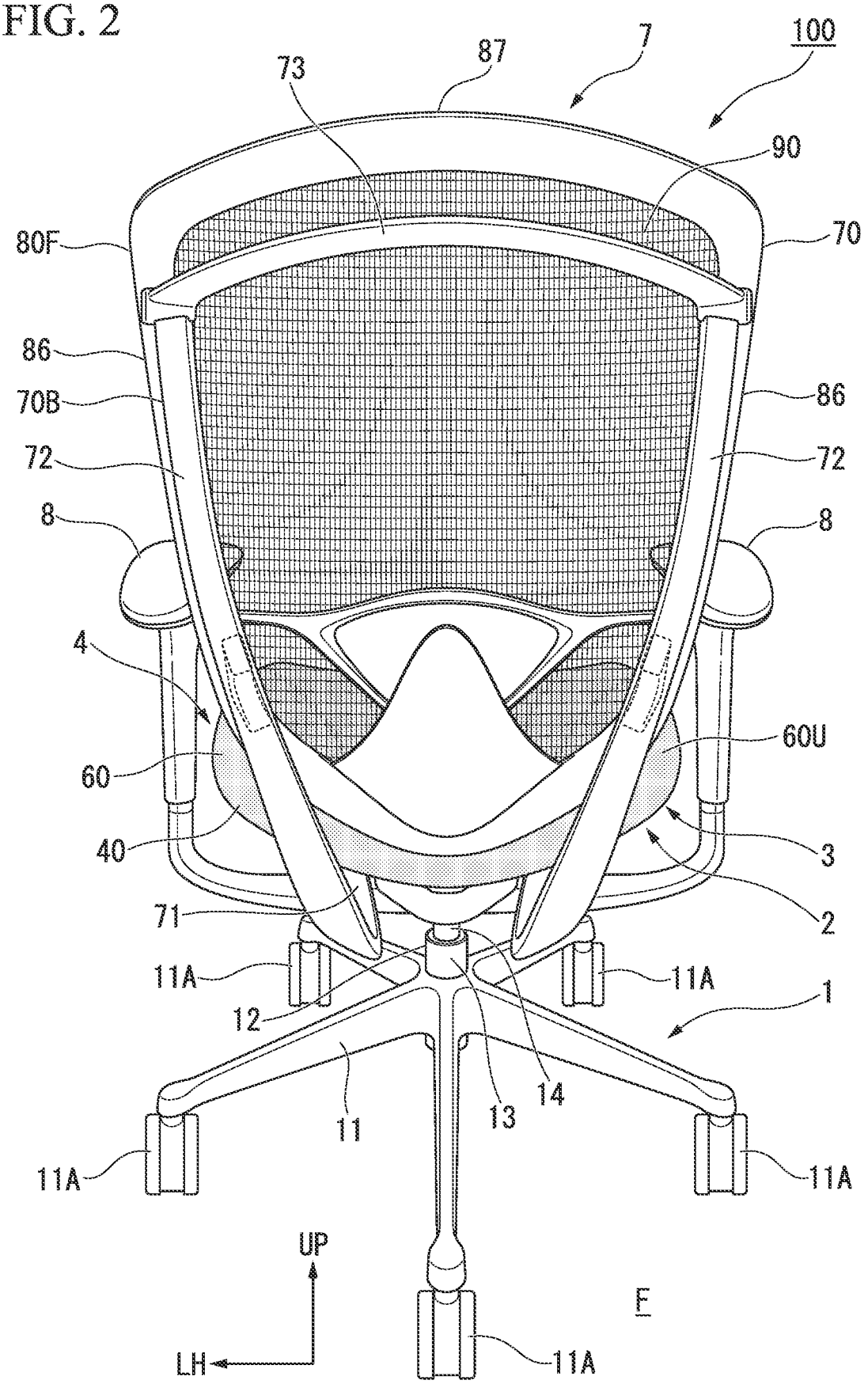
FIG. 2 is a rear perspective view of the chair according to the first embodiment of the present invention.

FIG. 1 is a perspective view of a chair according to a first embodiment of the present invention as seen from a side thereof. FIG. 2 is a perspective view of the chair according to the first embodiment of the present invention as seen from a back side (a backrest side) thereof.

As shown in FIGS. 1 and 2, a chair 100 includes a leg portion 1 which is provided on a floor surface F, a box-shaped support base 2 (not shown) which is provided on an upper portion of the leg portion 1, a seat-receiving member 3 which is mounted on an upper portion of the support base 2, a seat body 4 which is slidably supported on the seat-receiving member 3 for a seated person to be seated on, a backrest 7 which extends from the support base 2 and supports the back of the seated person seated on the seat body 4, and armrests 8 which are disposed as portions to the side of the backrest 7.

In the following description, for the sake of convenience, a direction of the seated person seated on the seat body 4 facing the front is referred to as "forward," and the direction opposite thereto is referred to as "rearward." Also, a direction in which the floor surface F side where the chair 100 is placed and the side opposite thereto are connected is referred to as a "vertical direction." Also, a width direction of the chair 100, that is, a horizontal direction orthogonal to a longitudinal direction is referred to as a "lateral direction." Also in the figures, a forward direction is indicated by an arrow FR, an upward direction is indicated by an arrow UP, and a left side is indicated by an arrow LH.

The leg portion 1 has a multi-legged leg 11 with casters 11A, and a pedestal 12 which stands upright from a central portion of the multi-legged leg 11 and incorporates a gas spring (not shown) that is an elevating mechanism. An outer cylinder 13 forming a lower portion of the pedestal 12 is fitted to and supported in a non-rotatable manner on the multi-legged leg 11. An inner cylinder 14 forming an upper portion of the pedestal 12 fixedly supports the support base 2 at an upper end portion thereof, and the lower portion thereof is supported by the outer cylinder 13 to be rotatable in the horizontal direction.

The support base 2 incorporates an elevation adjustment mechanism of the pedestal 12 and a tilt adjustment mechanism of the backrest 7. The seat-receiving member 3 has four link arms (not shown, hereinafter the same) mounted on the upper portion of the support base 2, and a pair of left and right fixed frames (not shown, hereinafter the same) for connecting the link arms to each other.

The seat body 4 has a seat frame 40 and a tension member 60 stretched around the seat frame 40. An upper surface of the tension member 60 serves as a load-supporting surface 60U that receives a load of the seated person.

The backrest 7 has a back frame 70 and a tension member 90 which is stretched around the back frame 70. A front surface of the tension member 90 defined as a load-supporting surface 90F that receives a load of the seated person. The back frame 70 has a rear back frame 70B connected to the support base 2, and a front back frame 80F provided in front of the back frame 70B.

The rear back frame 70B has a lower frame portion 71, a side frame portion 72, and an upper frame portion 73. The lower frame portion 71, the side frame portion 72, and the upper frame portion 73 are integrally formed of, for example, a metal such as aluminum or a resin having a predetermined strength.

The lower frame portions 71 are connected to the tilt adjustment mechanism in the support base 2 and extend from both left and right sides of a rear portion of the support base 2. The lower frame portion 71 gradually slopes rearward toward the upper side. In addition, an armrest 8 extending laterally is provided in each lower frame portion 71.

The side frame portion 72 is connected to an upper end portion of each lower frame portion 71. Each side frame portion 72 is gradually inclined outward in the lateral direction as it goes upward.

A lower portion of the side frame portion 72 is gradually inclined forward toward the upper side.

An upper portion of the side frame portion 72 is gradually inclined rearward toward the upper side. The upper portions of the respective side frame portions 72 are connected by the upper frame portion 73.

The front back frame 80F has an upper arm portion 81 which is connected to the upper portion of the side frame portion 72 of the rear back frame 70B, a lower arm portion 82 which is connected to the lower portion of the side frame portion 72, a pair of vertical rods 86 which are disposed apart from each other in the lateral direction (along the load-supporting surface 60U), and an upper rod 87 which connects upper ends of the pair of vertical rods 86 to each other. The upper arm portion 81, the lower arm portion 82, the vertical rods 86, and the upper rod 87 are integrally formed of a resin or the like, for example. The vertical rod 86 and the upper rod 87 are configured to be elastically deformable in response to the force applied from the tension member 90. The upper arm portion 81 is connected to an upper portion of the vertical rod 86 and a lower portion thereof is connected to the lower arm portion 82. Each of the vertical rods 86 extends in the vertical direction.

In detail, the vertical rod 86 is gradually inclined inward in the lateral direction as it goes downward. Lower ends of the pair of vertical rods 86 are connected to each other.

The armrests 8 are respectively provided on the left side and the right side in the width direction (the lateral direction) of the chair 100.

These armrests 8 have bilaterally symmetrical shapes. Therefore, in the following description, the armrest 8 provided on the right side of the chair 100 will be described in detail with reference to the drawings.

Figure 3:
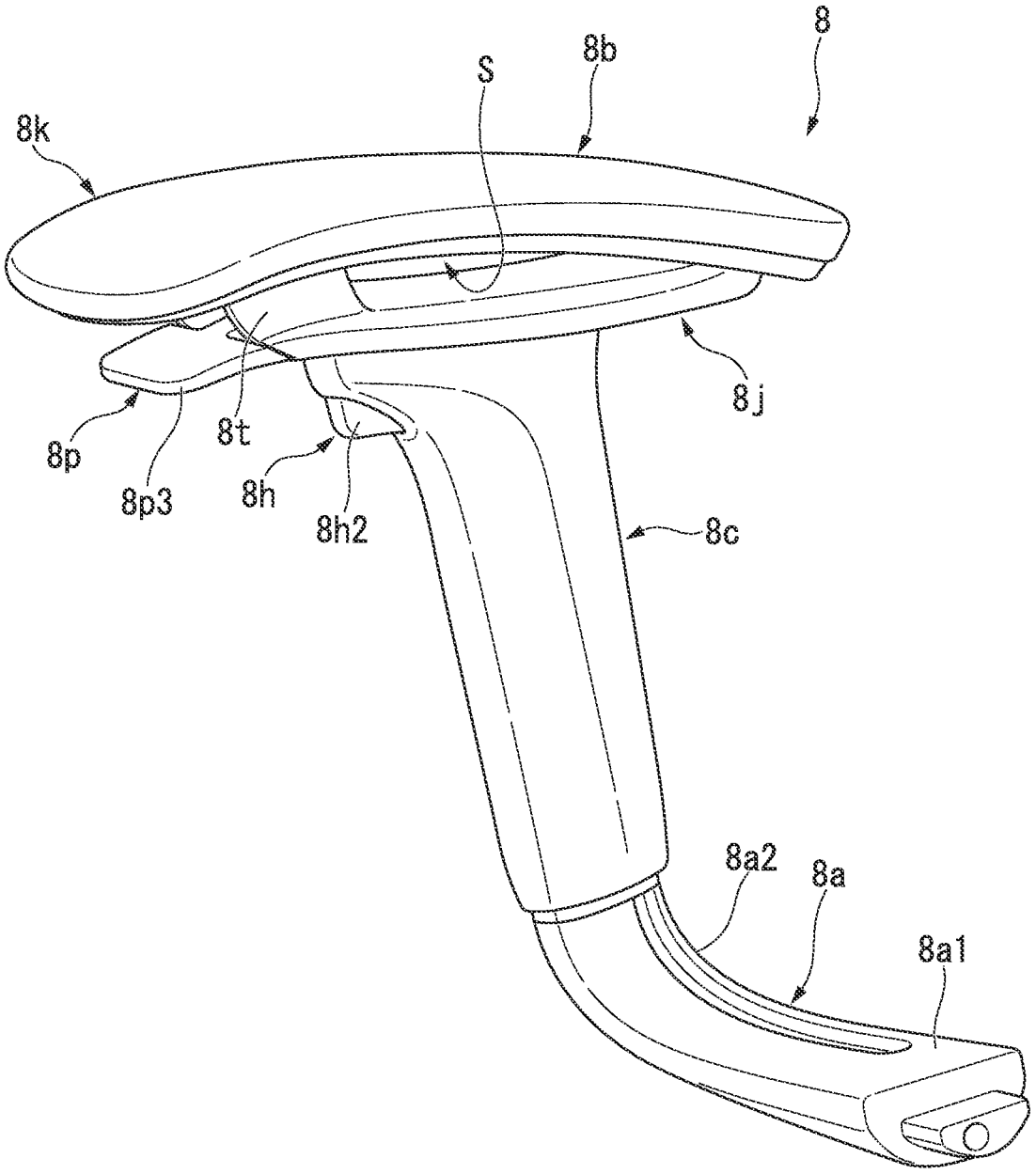
FIG. 3 is a perspective view of an armrest provided on the chair according to the first embodiment of the present invention.

FIG. 3 is a perspective view of the armrest 8. The armrest 8 includes a support rod 8*a* (a support member) with an L-shape in a front view which extends outward in the width direction from the lower frame portion 71 of the back frame 70 and then extends curvedly upward, an armrest body 8*b* (a movable member) which is supported by an upper end portion of the support rod 8*a* and extends in the longitudinal direction, and an elevating cylinder 8*c* which connects the armrest body 8*b* to be movable in the longitudinal direction.

The support rod 8*a* includes an outer extending portion 8*a*1 which extends outward in the width direction from the lower frame portion 71 of the back frame 70, an upper curved portion 8*a*2 which in continuous with an outside of the outer extending portion 8*a*1, and an upper standing portion 8*a*3 (see FIG. 4) which is continuous with an upper side of the upper curved portion 8*a*2.

The outer extending portion 8*a*1 and the upper curved portion 8*a*2 are integrally formed as a solid lower support rod made of, for example, an aluminum alloy. The upper standing portion 8*a*3 is formed as a hollow upper support rod made of, for example, a steel plate in a pipe shape which extends linearly in the vertical direction.

Figure 4:
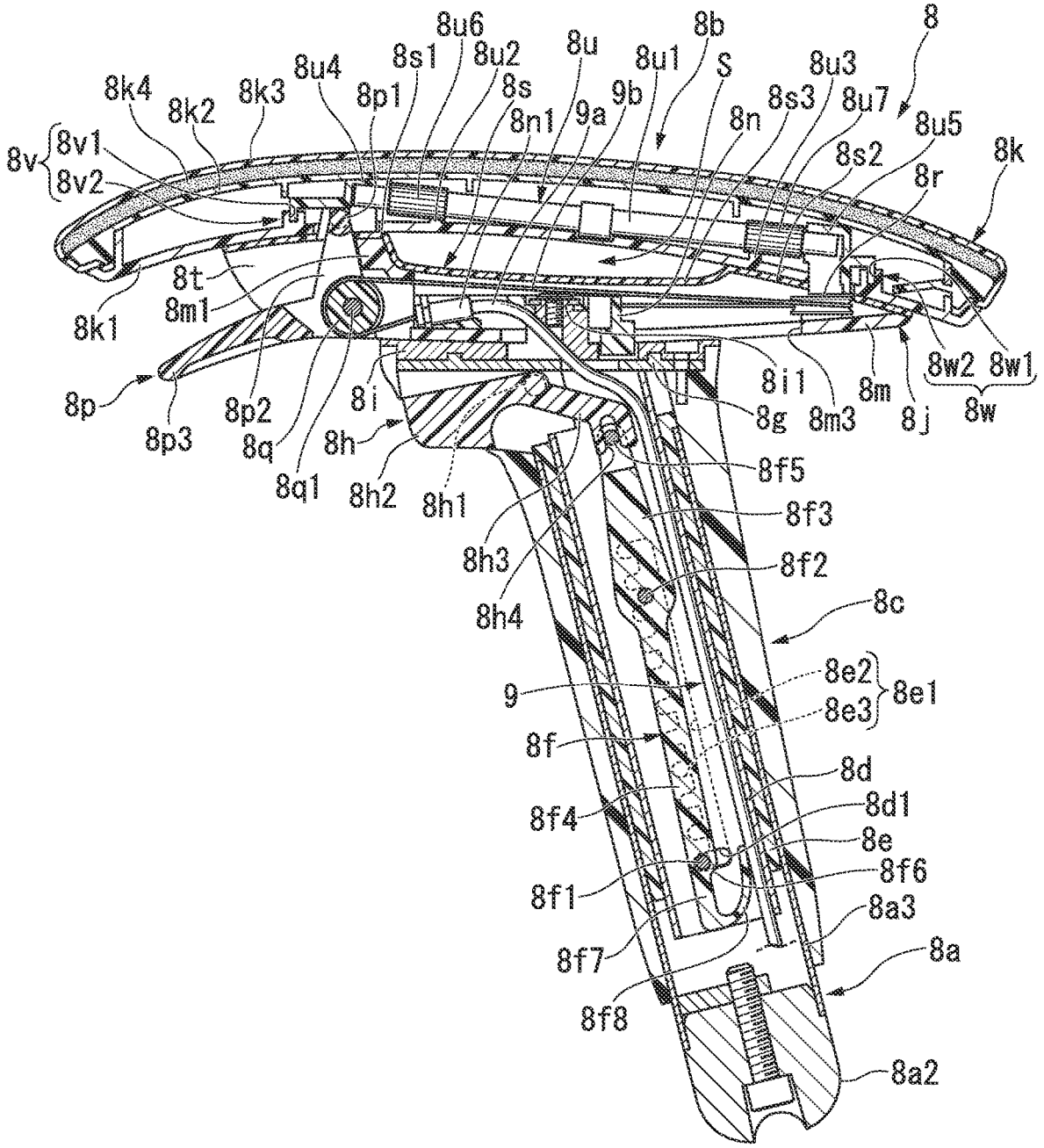
FIG. 4 is a side cross-sectional view of the armrest taken along a cross-section passing through an upper upright portion.

FIG. 4 is a side cross-sectional view of the armrest 8 taken along a cross-section passing through the upper standing portion 8*a*3. As shown in FIG. 4, the elevating cylinder 8*c* capable of moving up and down along the axis (extending direction) is externally fitted and an inner pipe 8*d* capable of moving up and down along the axis is internally fitted into the upper standing portion 8*a*3 (the upper support rod). The elevating cylinder 8*c* and the inner pipe 8*d* can be raised and lowered integrally with the armrest body 8*b*.

In addition, the armrest body 8*b* is movable in the longitudinal direction with respect to the elevating cylinder 8*c*, and is rotatable in plan view around a center of a pivot axis which will be described later. Further, a laterally movable portion 8*k*4 of an upper layer member 8*k* which will be described later is movable in the lateral direction with respect to a lower layer member 8*j* and the support rod 8*a*.

An inner sleeve 8*e* in which a height adjustment slit 8*e*1 with a comb-shape in a side view is formed is internally fitted into the upper standing portion 8*a*3. The inner sleeve 8*e* is fitted into the upper standing portion 8*a* and is fixed thereto using a snap fitting or the like. The height adjustment slit 8*e*1 has an elevating guide slit 8*e*2 which extends in the axial direction and a plurality of locking slits 8*e*3 which extend forward from the elevating guide slit 8*e*2.

A locking pin 8*f*1 capable of engaging with any locking slit 8*e*3 of the height adjustment slit 8*e*1 is held on a swing lever 8*f* which will be described later. The locking pin 8*f*1 extends in the lateral direction. Pin-moving holes 8*d*1 of an elongated hole-shape which is long in the longitudinal direction in a side view are formed in left and right side walls of the inner pipe 8*d*. In the pin-moving holes 8*d*1, left and right end portions of the locking pin 8*f*1 are inserted to be movable in the longitudinal direction.

When the locking pin 8*f*1 moves to a front end of the pin-moving hole 8*d*1, it can be engaged with any locking slit 8*e*3 of the height adjustment slit 8*e*1. At this time, the elevating of the armrest body 8*b* is locked. That is, a fixed height of the armrest body 8*b* can be adjusted in multiple stages by locking the locking pin 8*f*1 to any one of the locking slits 8*e*3.

When the locking pin 8*f*1 moves to a rear end of the pin-moving hole 8*d*1, it releases the engagement with the locking slit 8*e*3 and reaches the elevating guide slit 8*e*2. At this time, the elevating lock of the armrest body 8*b* is released, and the armrest body 8*b* can be raised and lowered (the height can be changed).

Inside the inner pipe 8*d*, a swing lever 8*f* is swingably supported via a support shaft 8*f*2 extending in the lateral direction. The swing lever 8*f* includes an upper extending portion 8*f*3 which extends above the support shaft 8*f*2 and a lower extending portion 8*f*4 which extends below the support shaft 8*f*2. An engaging pin 8*f*5 which slidably engages with a rear lower engaging groove 8*h*4 of an elevation control lever 8*h* which will be described later is provided at an upper end portion of the upper extending portion 8*f*3. A pin-holding portion 8*f*6 which holds the locking pin 8*f*1 is provided at a lower end portion of the lower extending portion 8*f*4. An extension portion 8*f*7 which extends downward is provided under the pin-holding portion 8*f*6, and a spring piece 8*f*8 which folds upward in an arc shape from a rear side of a lower end portion of the extension portion 8*f*7 is provided.

A top plate 8*g* which protrudes around the inner pipe 8*d* in plan view is fixed at an upper end of the inner pipe 8*d*. The elevation control lever 8*h* is swingably supported in front of the inner pipe 8*d* in the lower surface of the lop plate 8*g* via a support shaft 8*h*1 which extends in the lateral direction. The elevation control lever 8*h* includes a front extending portion 8*h*2 which extends in front of the support shaft 8*h*1, and a rear extending portion 8*h*3 which extends behind the support shall 8*h*1. The front extending portion 8*h*2 is provided such that a front lower portion thereof protrudes outside of an upper end portion of the elevating cylinder 8*c* such that a seated person can perform an operation of pushing it upward. The rear lower engaging groove 8*h*4 which engages with the engaging pin 8*f*5 at an upper end portion of the swing lever 8*f* is provided on a lower side of a rear end portion of the rear extending portion 8*h*3.

The swing lever 8*f* is biased such that a lower end portion thereof is displaced forward when a rear upper end of the spring piece 8*f*8 abuts against an inner wall of the inner pipe 8*d* (including an operation cable 9 passing through an inside of the inner pipe 8*d*, which will be described later) from the front. At this time, the locking pin 8*f*1 moves to the front end of the pin-moving hole 8*d*1 and is locked to any locking slit 8*e*3 of the height adjustment slit 8*e*1. When the lower end portion of the swing lever 8*f* is biased forward, the upper end portion of the swing lever 8*f* is displaced rearward, thereby displacing the rear end portion of the rear extending portion 8*h*3 of the elevation control lever 8*h* upward, so that the front extending portion 8*h*2 thus protrudes downward. When the front extending portion 8*h*2 is pushed upward, the rear end portion of the elevation control lever 8*h* displaces the upper end portion of the swing lever 8*f* forward, thereby displacing the lower end portion of the swing lever 8*f* rearward against a biasing force of the spring piece 8*f*8. Then, the locking pin 8*f*1 moves to the rear end of the pin-moving hole 8*d*1 and releases the engagement with the locking slit 8*e*3 of the height adjustment slit 8*e*1 while reaching the elevating guide slit 8*e*2, so that the armrest body 8*b* can be raised and lowered.

An end plate 8*i* having a pivot axis 8*i*1 is fixed on the top plate 8*g*. The end plate 8*i* is disposed to close an upper end opening of the elevating cylinder 8*c*. The armrest body 8*b* is supported on the end plate 8*i* to be rotatable around the pivot axis 8*i*1.

The armrest body 8*b* as the movable member includes a lower layer member 8*j* placed on the end plate 8*i* and the upper layer member 8*k* placed on the lower layer member 8*j*.

Figure 5:
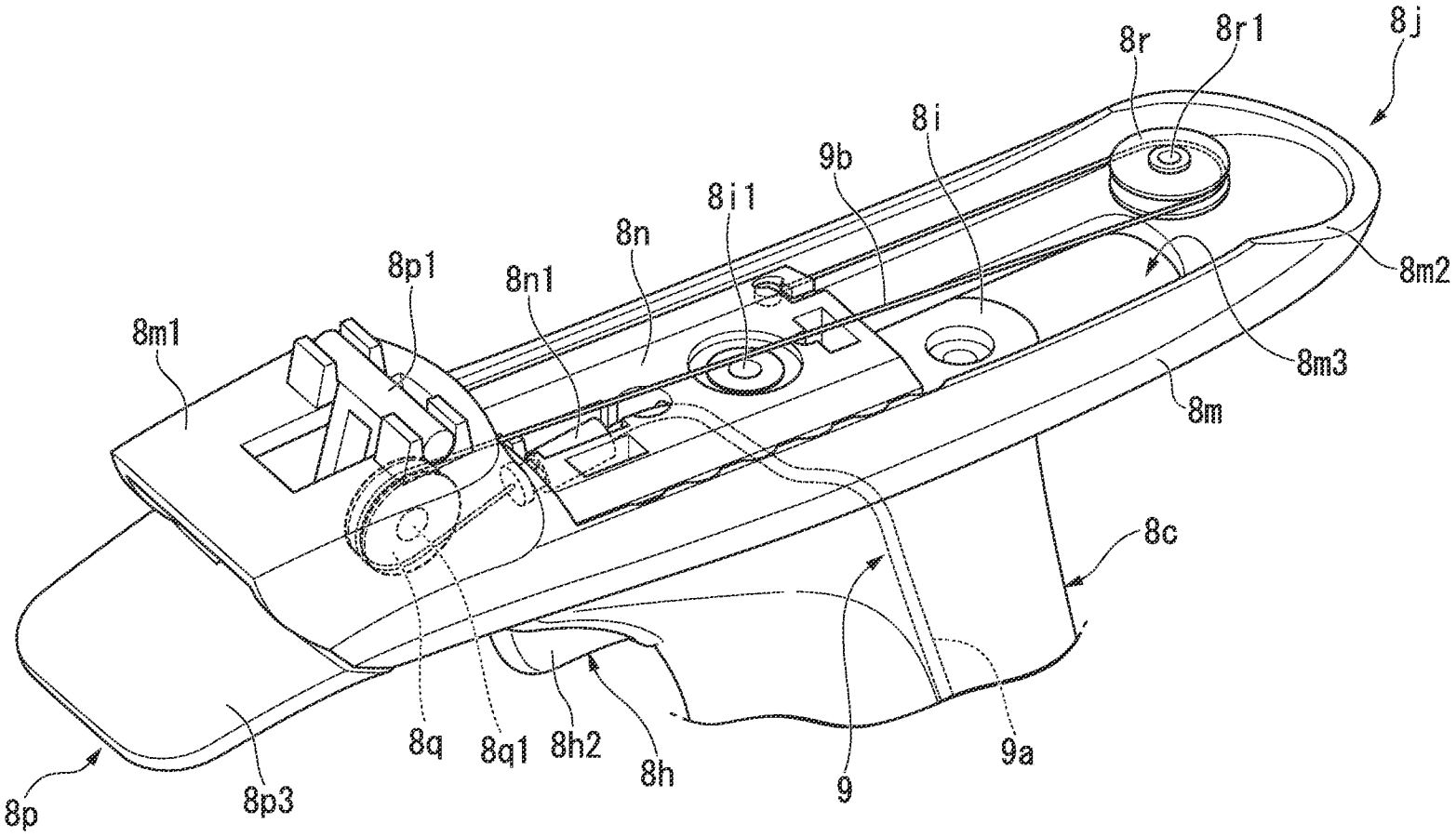
FIG. 5 is an enlarged perspective view including a lower layer member in which a cover member is omitted.

FIG. 5 is an enlarged perspective view including the lower layer member 8*j* in which a cover member 8*s* which will be described later is omitted. As shown in the figure, the lower layer member 8*j* includes: a base member 8*m* which forms an accommodating space that opens upward and is placed on the end plate 8*i* with the pivot axis 8*i*1 protruded into the accommodating space; a rotatable member 8*n* which is fitted to the base member 8*m* to be non-rotatable relative to the base member 8*m* and movable in the longitudinal direction within the accommodating space and is rotatably fitted to the pivot axis 8*i*1; an operation lever 8*p* for remotely operating devices (the elevation adjustment mechanism of the pedestal 12 and the tilt adjustment mechanism of the backrest 7) in the support base 2 via the operation cable 9; a front pulley 8*q* and a rear pulley 8*r* which wind an inner cable 9*b* of the operation cable 9 inside the lower layer member 8*j*; and a cover member 8*s* (see FIG. 4) which closes an upper open portion of the accommodating space. The lower layer member 8*j* is supported by the support rod 8*a* from below.

A front end portion of the base member 8*m* has a front step portion 8*m*1 formed (herein which is changed upward in a stepped shape with respect to the accommodating space to support a front portion of the upper layer member 8*k*. A rear end portion of the base member 8*m* has a rear inclined portion 8*m*2 formed therein which is inclined downward in the rearward direction to support a rear portion of the upper layer member 8*k*. The rear inclined portion 8*m*2 is formed such that a depth of a rear end portion of the accommodating space becomes shallower toward the rearward side. An elongated hole 8*m*3 through which the pivot axis 8*i*1 passes and which extends in the longitudinal direction is formed on a bottom wall of the base member 8*m*.

The rotatable member 8*n* is formed in a flat rectangular parallelepiped shape in which the width in the vertical direction (the direction along the axial line of the pivot axis 8*i*1) is reduced. In plan view, the rotatable member 8*n* is disposed such that front and rear surfaces thereof are aligned in the lateral direction and left and right side surfaces thereof are aligned in the longitudinal direction (the direction along left and right side walls of the base member 8*m*).

The operation lever 8*p* is formed in an L-shape in a side view. The operation lever 8*p* includes a support shaft 8*p*1 which extends in the lateral direction and is rotatably supported on the front step portion 8*m*1, a downward extending portion 8*p*2 which extends downward from the support shaft 8*p*1, and a forward extending portion 8*p*3 which extends forward from a lower end of the downward extending portion 8*p*2. The operation lever 8*p* is swingable around the support shaft 8*p*1 in a swing space inside the front step portion 8*m*1. A front portion of the forward extending portion 8*p*3 protrudes forward in a lower portion of the front step portion 8*m*1 and is capable of an operation of being pushed upward. The forward extending portion 8*p*3 is positioned below the front portion of the upper layer member 8*k*. The forward extending portion 8*p*3 is operable such that the seated person putting his/her arm on the upper layer member 8*k* can pull it up with a fingertip.

The front pulley 8*q* is rotatably supported at a lower end portion of the downward extending portion 8*p*2 of the operation lever 8*p* via a support shaft 8*q*1 which extends in the lateral direction. The front pulley 8*q* moves forward in accordance with a rotation of the downward extending portion 8*p*2 when a front portion of the downward extending portion 8*p*2 pivots upward due to a pull-up operation of the forward extending portion 8*p*3.

The rear pulley 8*r* is rotatably supported at a rear end portion of the bottom wall of the base member 8*m* via a support shaft 8*r*1 which is aliened along the vertical direction. The rear pulley 8*r* is disposed at a rear end portion of the accommodating space whose depth is reduced by the rear inclined portion 8*m*2. By disposing the rear pulley 8*r* to be laid, it is easier to arrange it even in a shallow space as compared with the case of an upright arrangement such as the front pulley 8*q*.

The operation cable 9 includes an outer cable 9*a* and the inner cable 9*b*. The operation cable 9 extends from the support base 2 through the inner pipe 8*d* and reaches an inside of the lower layer member 8*j*.

The outer cable 9*a* of the operation cable 9 has a tip end locked to an outer cable locking portion 8*n*1 which is formed in the rotatable member 8*n*. After the inner cable 9*b* of the operation cable 9 extends forward from a front end portion of the outer cable 9*a*, the inner cable 9*b* is wound around the front pulley 8*q* from a lower side to an upper side and folds rearward. Then, the inner cable 9*b* is wound around the rear pulley 8*r* from one side to the other side in the width direction (in the figure, from an inner side to an outer side in the width direction) and folds forward. Then, a tip end portion of the inner cable 9*b* is engaged with an outer side of a rear end portion of the rotatable member 8*n* in the width direction.

In the above configuration, when the forward extending portion 8*p*3 of the operation lever 8*p* is pulled up, the front pulley 8*q* moves upward in a forward direction to draw out the inner cable 9*b*, whereby the devices in the support base 2 are operated.

Here, the front pulley 8*q* is moved in the longitudinal direction also when the armrest body 8*b* is moved in the longitudinal direction. At this time, in accordance with movement of the front pulley 8*q* back and forth in front of the front end portion of the outer cable 9*a*, the rear pulley 8*r* moves back and forth behind a front end portion of the inner cable 9*b*. For this reason, even if the length of the inner cable 9*b* in front of the front end portion of the outer cable 9*a* increases or decreases, the length of the inner cable 9*b* behind the front end portion of the inner cable 9*b* decreases or increases by the same amount. Therefore, since a change in a pull-out length of the inner cable 9*b* is suppressed, the inner cable 9*b* is prevented from being stretched when the armrest body 8*b* moves forward or the inner cable 9*b* is prevented front being loosened when the armrest body 8*b* is moved rearward.

The cover member 8*s* includes a front step cover portion 8*s*1 which is formed in a stepped shape to be aligned with the front step portion 8*m*1, a rear inclined cover portion 8*s*2 which is inclined to be aligned with the rear inclined portion 8*m*2 and extends to a forward side of the rear inclined portion 8*m*2, and an intermediate wall portion 8*s*3 which is provided apart from the upper layer member 8*k* between the front step cover portion 8*s*1 and the rear inclined cover portion 8*s*2. The front step cover portion 8*s*1 forms a front upright portion which stands upward from a front end of the intermediate wall portion 8s3, and the rear inclined cover portion 8s2 forms a rear upright portion which stands upward relatively low and gently from a rear end of the intermediate wall portion 8s3. A through-space S which passes through the armrest body 8b in the lateral direction is formed between the intermediate wall portion 8s3 and the upper layer member 8k. A front support portion 8t (a spacer member) which is formed by the front step portion 8m1 and the front step cover portion 8s1 and supports the front portion of the upper layer member 8k is provided in front of the through-space S. This front support portion 8t forms the through-space S by separating a part of the lower layer member 8j from a part of the upper layer member 8k. The through-space S is formed to penetrate in the width direction of the chair 100, and can be used as a space for inserting a finger of the seated person when moving the armrest body 8b in the longitudinal direction with respect to the support rod 8a or when moving the upper layer member 8k in the lateral direction with respect to the lower layer member 8j. This through-space S is shaped and arranged for the seated person to grasp easily, and functions as a guide portion for guiding the seated person so that the hand of the seated person is naturally inserted into the through-space S when the seated person attempts to move the armrest body 8b. Also, although the lower layer member 8j and the support rod 8a move relative to each other when the armrest body 8b is moved in the longitudinal direction, the through-space S is formed above the space between the lower layer member 8j and the support rod 8a.

The upper layer member 8k includes a base member 8k1 which is fixed on the front support portion 8t and the rear inclined cover portion 8s2 of the lower layer member 8j, a cover member 8k2 which overlaps on the base member 8k1 with an accommodating space therebetween, a pad member 8k3 which covers the cover member 8k2 from above and includes an upper surface that serves as a placing surface for supporting a limb of the seated person, and a cushion member 8k4 which is interposed between the cover member 8k2 and the pad member 8k3 and is made of urethane or the like. The upper layer member 8k has a moderately curved shape convex upward in a side view, and its front portion is inclined downward in the forward direction and its rear portion is inclined downward in the rearward direction. The base member 8k1 is placed on the lower layer member 8j and is slidable in the lateral direction. Further, the cover member 8k2, the pad member 8k3, and the cushion member 8k4 are also movable in the lateral direction with respect to the lower layer member 8j together with the base member 8k1. This upper layer member 8k is supported by the lower layer member 8j from below while forming the through-space S between itself and a part (a central portion in the longitudinal direction) of the lower layer member 8j, and is disposed partially opposite to the part of the lower layer member 8j.

In the accommodating space of the upper layer member 8k, a movement-equalizing mechanism 8u is provided for moving the upper layer member 8k that is long in the longitudinal direction parallel in the lateral direction.

When the upper layer member 8k which is long in the longitudinal direction is moved in the lateral direction, there is a case in which the operation of grasping any of the front and rear end portions of the upper layer member 8k may cause tilting of the upper layer member 8k in plan view to obstruct a smooth lateral movement or rotating of the armrest body 8b about the pivot axis 8i1 unintentionally. In contrast to this, by equalizing the lateral movement of the front and rear end portions of the upper layer member 8k using the movement-equalizing mechanism 8u, it is possible to assist the parallel movement of the upper layer member 8k in the lateral direction.

The movement-equalizing mechanism 8u includes an interlocking shaft 8u1 which extends in the longitudinal direction in the accommodating space of the upper layer member 8k, a front rack 8u2 and a rear rack 8u3 which are formed to extend in the lateral direction on the base member 8k1, a front bearing portion 8u4 which is disposed on a front side of the interlocking shaft 8u1, and a rear bearing portion 8u5 which is disposed on a rear side of the interlocking shaft 8u1.

A front end portion of the interlocking shaft 8u1 is rotatably supported by the front bearing portion 8u4 which is accommodated in the upper layer member 8k movably in the lateral direction. A rear end portion of the interlocking shaft 8u1 is rotatably supported by the rear bearing portion 8u5 which is accommodated in the upper layer member 8k movably in the lateral direction. A front pinion gear 8u6 is formed at a front portion of the interlocking shaft 8u1. A rear pinion gear 8u7 is formed at a rear portion of the interlocking shaft 8u1. The front pinion gear 8u6 is engaged with the front rack 8u2. The rear pinion gear 8u7 is engaged with the rear rack 8u3. The front bearing portion 8u4 and the rear bearing portion 8u5 are fixed to the lower layer member 8j and are fixed thereto even when the upper layer member 8k moves.

A guide protruding portion 8v1 whose tip is directed downward is provided at a front end of the front bearing portion 8u4. A guide groove portion 8v2 formed in the lateral direction (the moving direction of the upper layer member 8k) is provided on a front upper surface of the base member 8k1. The guide protruding portion 8v1 is slidably engaged with the guide groove portion 8v2. The guide protruding portion 8v1 and the guide groove portion 8v2 form a front guide portion 8v.

A guide protruding portion 8w1 whose tip is directed downward is provided at a rear end of the rear bearing portion 8u5. A guide groove portion 8w2 formed in the lateral direction (the moving direction of the upper layer member 8k) is provided on a rear upper surface of the base member 8k1. The guide protruding portion 8w1 is slidably engaged with the guide groove portion 8w2. The guide protruding portion 8w1 and the guide groove portion 8w2 form a rear guide portion 8w.

If the front end portion or the rear end portion of the upper layer member 8k is grasped and the upper layer member 8k is attempted to be moved in the lateral direction in the above configuration, the rack (the front rack 8u2 or the rear rack 8u3) moves and the pinion gear (the front pinion gear 8u6 or the rear pinion gear 8u7) at the end portion on the side (the driving side) gripped by the seated person among the front and rear end portions of the upper layer member 8k rotates. As a result, the interlocking shaft 8u1 rotates and the side (the driven side) opposite to the upper layer member 8k separated by the length of the interlocking shaft 8u1 is moved in the lateral direction by the pinion gear and the rack at the end portion of the side opposite thereto by the same amount as the end portion on the driving side is moved. Thus, the parallel movement of the upper layer member 8k in the lateral direction is promoted.

The chair 100 and the armrest 8 of the first embodiment as described above have the armrest body 8b which includes the placing surface for supporting the limb of the seated person and is supported by the support rod 8a from below to be movable in the longitudinal direction, and the through-space S which indicates the position touched when the seated person moves the armrest body 8*b*. For this reason, the hand of the seated person can be guided to a position suitable for moving the armrest body 8*b* in the longitudinal direction with respect to the support rod 8*a*, whereby it is possible to prevent the seated person from moving the armrest body 8*b* in a state where the seated person can touch an unexpected portion.

Also, in the chair 100 and the armrest 8 of the first embodiment, the through-space S (the recessed portion) which is provided on an outer side surface of the armrest body 8*b* and is recessed in the width direction of the chair 100 functions as the guide portion. For this reason, the seated person can confirm the position of the through-space S based on the feel of the fingertip or the like without continuously observing the through-space S. Therefore, it is possible to more reliably guide the seated person to the through-space S.

In addition, in the chair 100 and the armrest 8 of the first embodiment, the through-space S penetrates from one side to the other side of the movable member in the width direction of the chair. Therefore, the seated person can insert fingers into the through-space S from both sides of the armrest 8 in the width direction. For example, since the thumb of the seated person can be inserted into the through-space S from one side of the armrest 8 in the width direction, and fingers other than the thumb of the seated person can be inserted into the through-space S from the other side of the armrest 8 in the width direction, it is possible to stably hold the upper layer member 8*k*. Further, since there is no member that prevents the fingers from being inserted into the through-space S, the fingers of the seated person can be inserted deeply into the through-space S, thereby making it possible to hold the upper member 8*k* more stably.

In the chair 100 and the armrest 8 of the first embodiment, the through-space S is disposed above the space between the armrest body 8*b* and the support rod 8*a*. In general, when the seated person grasps the armrest body 8*b*, the seated person touches the armrest body 8*b* from above the armrest body 8*b*. Here, according to the present configuration, the hand of the seated person reaches the through-space S before reaching between the armrest body 8*b* and the support rod 8*a*. Therefore, it is possible to restrain the hand of the seated person from approaching the support rod 8*a* or the elevating cylinder 8*c*, thereby more reliably inhibiting the touching of the fingertip or the like of the seated person on an unexpected portion when the armrest body 8*b* is moved.

While the preferred embodiments of the present invention have been described above with reference to the accompanying drawings, the present invention is not limited to the first embodiment. The shapes and combinations of the constituent members shown in the first embodiment described above are merely examples and can be variously modified in accordance with design requirements in the range without departing from the object of the present invention.

Figure 6A:
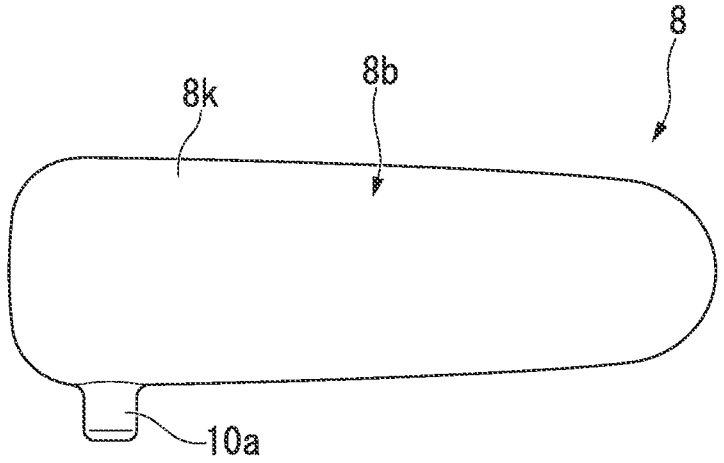
FIG. 6A is a schematic plan view showing a first modification of the armrest.
Figure 6B:
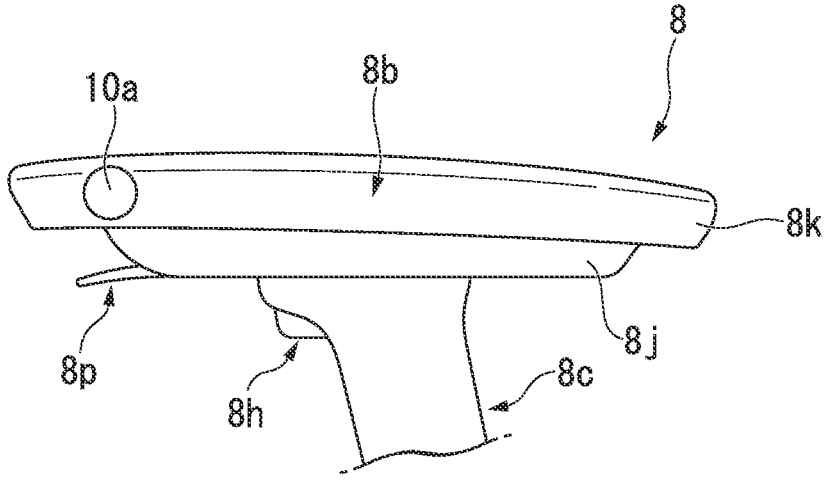
FIG. 6B is a schematic side view showing the first modification of the armrest.
Figure 7A:
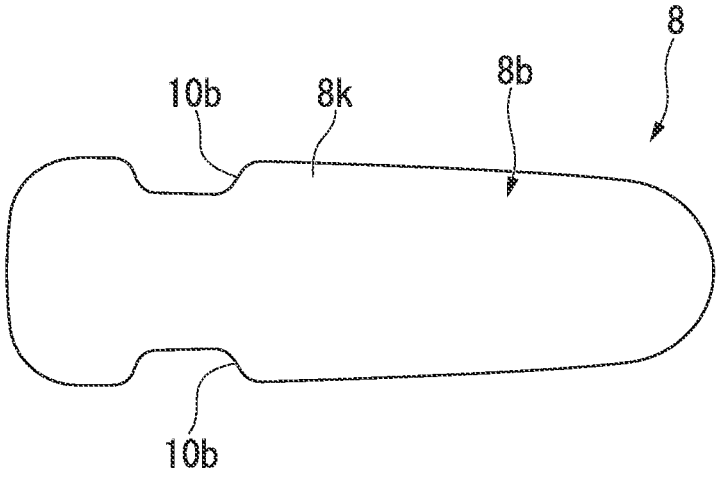
FIG. 7A is a schematic plan view showing a second modification of the armrest.
Figure 7B:
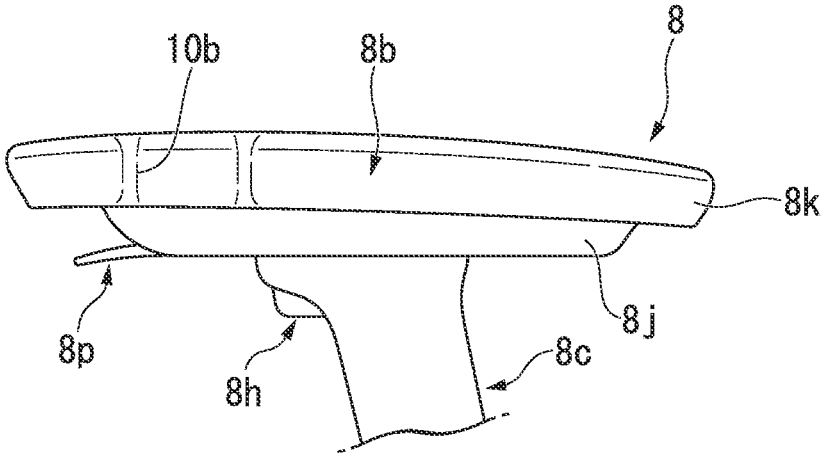
FIG. 7B is a schematic side view showing the second modification of the armrest.

FIG. 6A and FIG. 6B are schematic diagrams showing a first modification of the present invention. FIGS. 7A and 7B are schematic diagrams showing a second modification of the present invention. In these figures, FIGS. 6A and 7A are plan views, and FIGS. 6B and 7B are side views. In the first embodiment, the configuration in which the through-space S functions as a guide portion of the present invention has been described. However, the present invention is not limited thereto. For example, as shown in FIGS. 6A and 6B, a projecting portion 10*a* which protrudes sideways relative to the upper layer member 8*k* is included as a guide portion. Also, as shown in FIGS. 7A and 7B, a recessed portion 10*b* is included on a side portion of the upper layer member 8*k* as a guide portion. In addition, an upper surface of the upper layer member 8*k* includes a protruding portion and a recessed portion as guide portions.

In addition, in the first embodiment, the upper layer member 8*k* is movable in the lateral direction with respect to the lower layer member 8*j*. However, the present invention is not limited thereto, and the upper layer member 8*k* may be fixed to the lower layer member 8*j*.

Further, in the first embodiment, the through-space S passes through in the width direction of the chair 100. However, the present invention is not limited thereto, and only a recessed portion recessed in the width direction may be formed and this recessed portion can serve as a guide portion.

Second Embodiment

A second embodiment, of the armrest and chair according in the present invention will now be described with a reference to the drawings.

In the following figures, the scales of respective members may be appropriately changed to make each member have a recognizable size.

Figure 8:
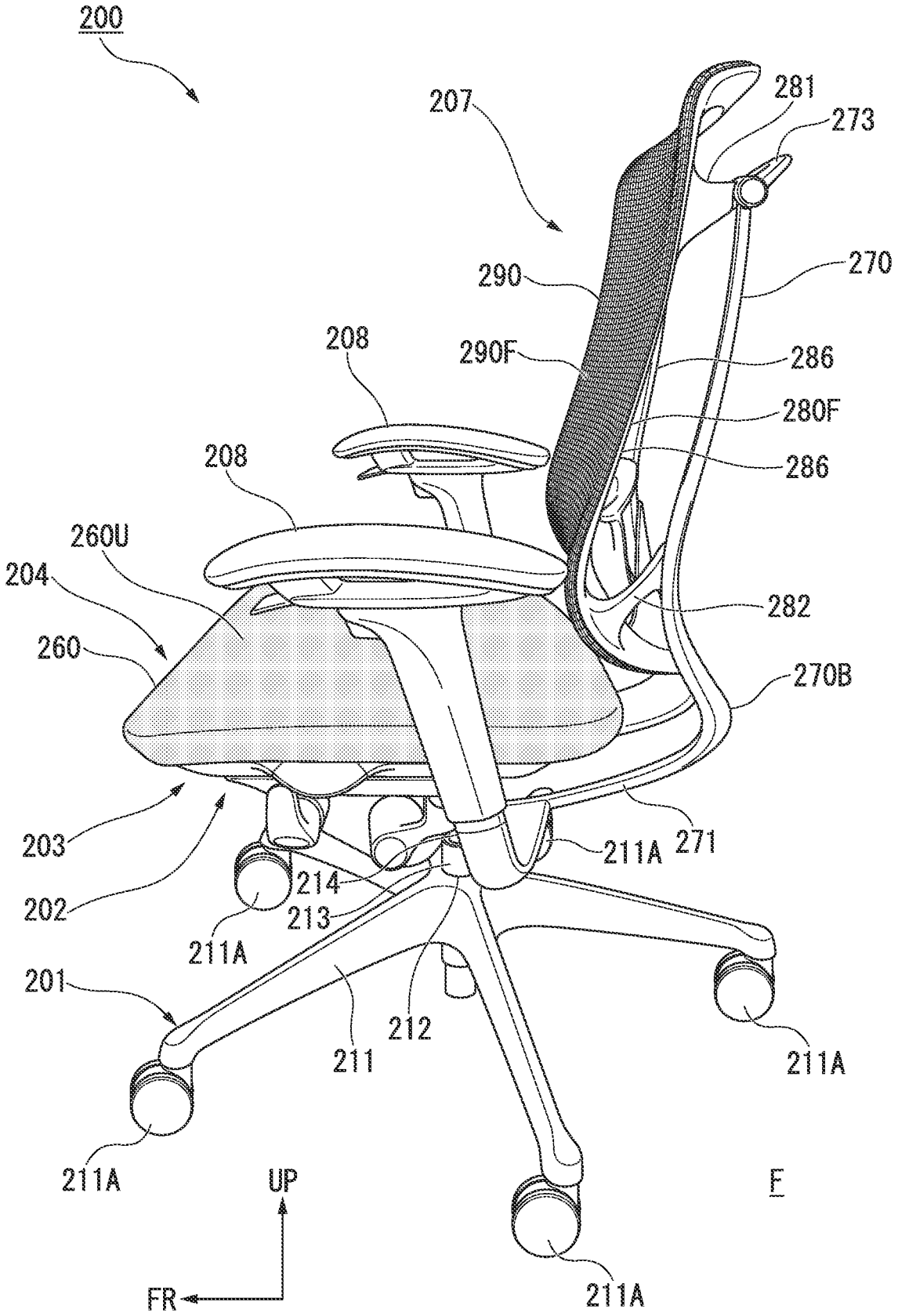
FIG. 8 is a side perspective view of a chair according to a second embodiment of the present invention.
Figure 9:
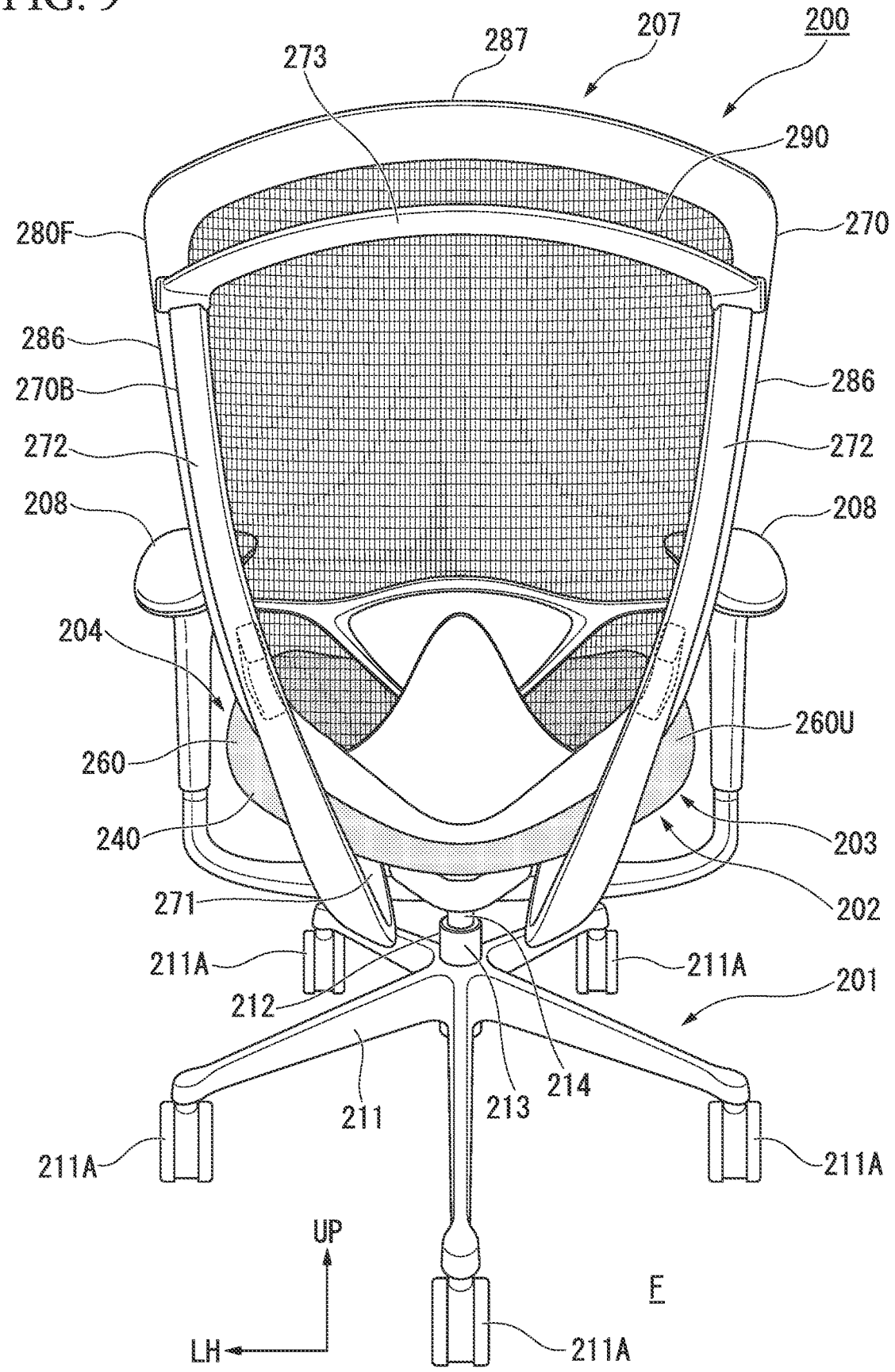
FIG. 9 is a rear perspective view of the chair according to the second embodiment of the present invention.

FIG. 8 is a perspective view of the chair according to the second embodiment of the present invention as seen from the side. FIG. 9 is a perspective view of the chair according to the second embodiment of the present invention as seen from the rear (the backrest side).

As shown in FIGS. 8 and 9, the chair 200 includes a leg portion 201 which is provided on a floor surface F, a box-shaped support base 202 (not shown) which is provided at an upper portion of the leg portion 201, a seat-receiving member 203 which is mounted on an upper portion of the support base 202, a seat body 204 which is slidably supported on the seat-receiving member 203 for a seated person to be seated on, a backrest 207 which extends from the support base 202 and supports the back of the seated person seated on the seat body 204, and armrests 208 which are disposed at portions to the side of the backrest 207.

In the following description, for the sake of convenience, a direction of the seated person seated on the seat body 204 facing the front is referred to as a "forward," and the direction opposite thereto is referred to as a "rearward." A direction in which the floor surface F side where the chair 200 is placed and the side opposite thereto are connected is referred to as a "vertical direction." Also, a width direction of the chair 200, that is, a horizontal direction orthogonal to a longitudinal direction is referred to as a "lateral direction." Also in the figures, a forward direction is indicated by an arrow FR, an upward direction is indicated by an arrow UP, and a left side is indicated by an arrow LH.

The leg portion 201 has a multi-legged leg 211 with casters 211A, and a pedestal 212 which stands upright from a central portion of the multi-legged leg 211 and incorporates a gas spring (not shown) that is an elevating mechanism. An outer cylinder 213 forming a lower portion of the pedestal 212 is fitted to and supported in a non-rotatable manner on the multi-legged leg 211. An inner cylinder 214 forming an upper portion of the pedestal 212 fixedly supports the support base 202 at an upper end portion thereof, and the lower portion thereof is supported by the outer cylinder 213 to be rotatable in the horizontal direction.

The support base 202 incorporates an elevation adjustment mechanism of the pedestal 212 and a tilt adjustment mechanism of the backrest 207. The seat receiving member 203 has four link arms (not shown, hereinafter the same)

mounted on the upper portion of the support base 202, and a pair of left and right fixed frames (not shown, hereinafter the same) for connecting the link arms to each other.

The seat body 204 has a seat frame 240 and a tension member 260 stretched around the seat frame 240. An upper surface of the tension member 260 serves as a load-supporting surface 260U that receives a load of the seated person.

The backrest 207 has a back frame 270 and a tension member 290 stretched around the back frame 270. A front surface of the tension member 290 is defined as a load-supporting surface 290F that receives a load of the seated person. The back frame 270 has a rear back frame 270B connected to the support base 202, and a front back frame 280F provided in front of the back frame 270B.

The rear back frame 270B has a lower frame portion 271, a side frame portion 272, and an upper frame portion 273. The lower frame portion 271, the side frame portion 272, and the upper frame portion 273 are integrally formed of, for example, a metal such as aluminum or a resin having a predetermined strength.

The lower frame portions 271 are connected to the tilt adjustment mechanism in the support base 202 and extend from both left and right sides of a rear portion of the support base 202. The lower frame portion 271 gradually slopes rearward toward the upper side. In addition, an armrest 208 extending laterally is provided in each lower frame portion 271.

The side frame portion 272 is connected to an upper end portion of each lower frame portion 271. Each side frame portion 272 is gradually inclined outward in the lateral direction as it goes upward.

A lower portion of the side frame portion 272 is gradually inclined forward toward the upper side.

An upper portion of the side frame portion 272 is gradually inclined rearward toward the upper side. The upper portions of the respective side frame portions 272 are connected by the upper frame portion 273.

The front back frame 280F has an upper arm portion 281 which is connected to the upper portion of the side frame portion 272 of the rear back frame 270B, a lower arm portion 282 which is connected to the lower portion of the side frame portion 272, a pair of vertical rods 286 which are disposed apart from each other in the lateral direction (along the load-supporting surface 260U, and an upper rod 287 which connects upper ends of the pair of vertical rods 286 to each other. The upper arm portion 281, the lower arm portion 282, the vertical rods 286, and the upper rod 287 are integrally formed of a resin or the like, for example. The vertical rod 286 and the upper rod 287 are configured to be elastically deformable in response to the force applied from the tension member 200. The upper arm portion 281 is connected to an upper portion of the vertical rod 286 and a lower portion thereof is connected to the lower arm portion 282. Each of the vertical rods 286 extends in the vertical direction.

In detail, the vertical rod 286 is gradually inclined inward in the lateral direction as it goes downward. Lower ends or the pair of vertical rods 286 are connected to each other.

The armrests 208 are respectively provided on the left side and the right side in the width direction (the lateral direction) of the chair 200.

These armrests 208 have bilaterally symmetrical shapes. Therefore, in the following description, the armrest 208 provided on the right side of the chair 200 will be described in detail with reference to the drawings.

Figure 10:
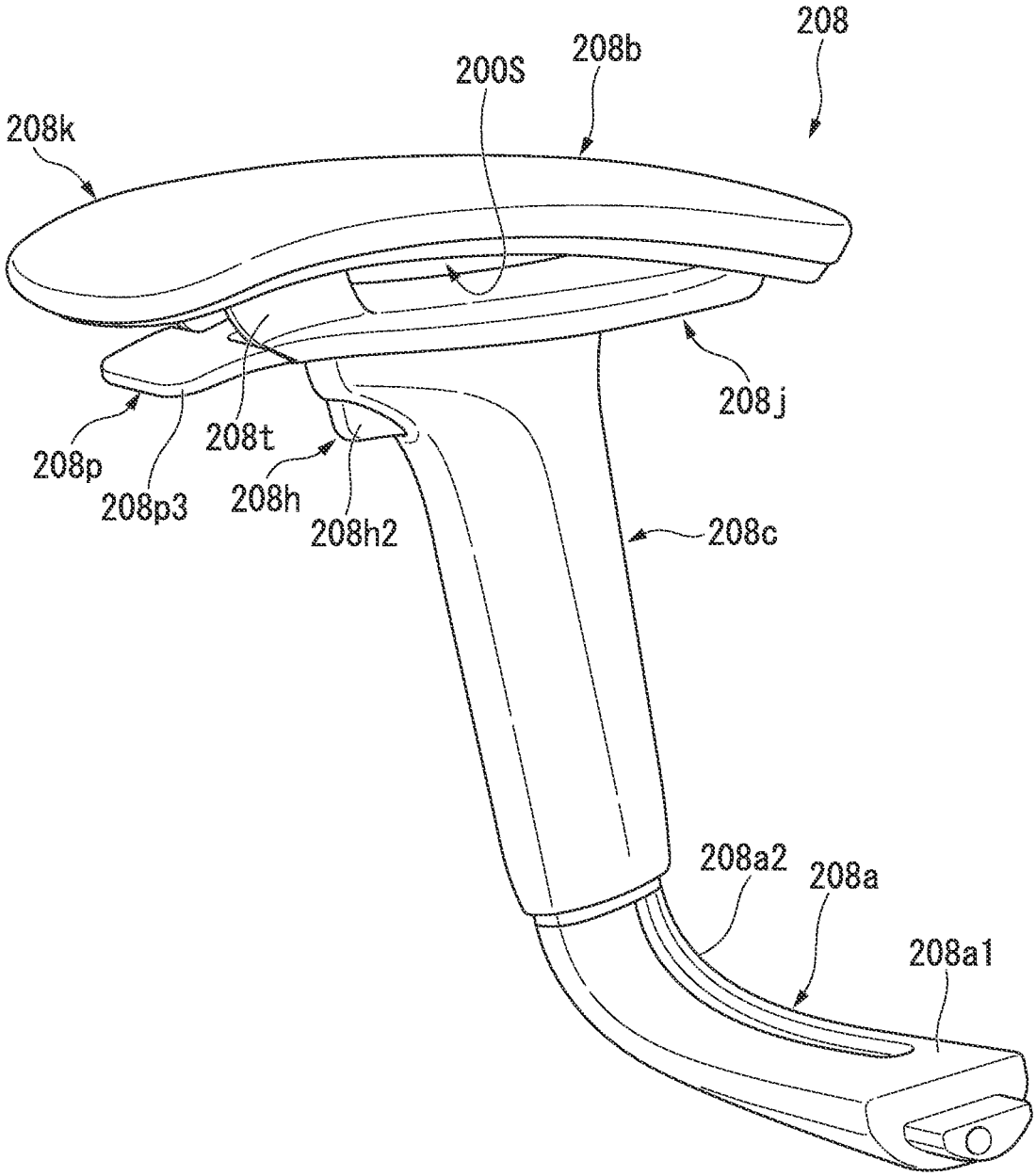
FIG. 10 is a perspective view of an armrest provided in the chair according to the second embodiment of the present invention.

FIG. 10 is a perspective view of the armrest 208. The armrest 208 includes a support rod 208*a* (a support member) with an L-shape in a front view which extends outward in the width direction from the lower frame portion 271 of the back frame 270 and then extends curvedly upward, an armrest body 208*b* (a movable member) which is supported by an upper end portion of the support rod 208*a* and extends in the longitudinal direction, and an elevating cylinder 208*c* which supports the armrest body 208*b* to be movable in the longitudinal direction.

The support rod 208*a* includes an outer extending portion 208*a*1 which extends outward in the width direction from the lower frame portion 271 of the back frame 270, an upper curved portion 208*a*2 which is continuous with an outer side of the outer extending portion 208*a*1, and an upper standing portion 208*a*3 (see FIG. 11) which is continuous with an upper side of the upper curved portion 208*a*2.

The outer extending portion 208*a*1 and the upper curved portion 208*a*2 are integrally formed as a solid lower support rod made of, for example, an aluminum alloy. The upper standing portion 208*a*3 is formed as a hollow upper support rod made of, for example, a steel plate in a pipe shape which extends linearly in the vertical direction.

Figure 11:
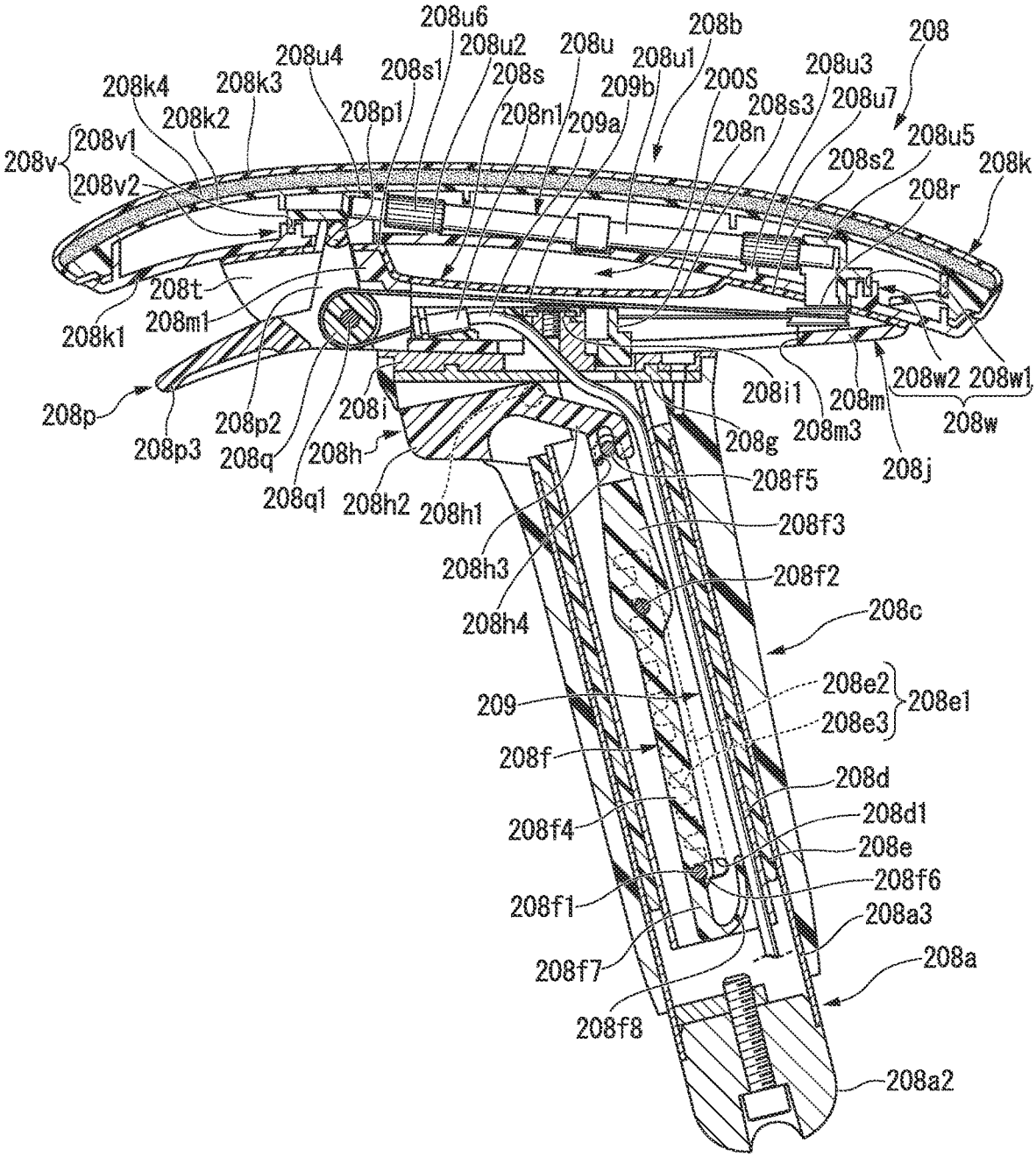
FIG. 11 is a side cross-sectional view of the armrest taken along a cross-section passing through an upper standing portion.

FIG. 11 is a side cross sectional view of the armrest 208 taken along a cross-section passing through the upper standing portion 208*a*3. As shown in FIG. 11, the elevating cylinder 208*c* capable of moving up and down along the axis (extending direction) is externally fitted and an inner pipe 208*d* capable of moving up and down along the axis is internally fitted into the upper standing portion 208*a*3 (the upper support rod). The elevating cylinder 208*c* and the inner pipe 208*d* can be raised and lowered integrally with the armrest body 208*b*.

In addition, the armrest body 208*b* is movable in the longitudinal direction with respect to the elevating cylinder 201*c*, and is rotatable in plan view around a center of a pivot axis which will be described later. Further, an upper layer member 208*k* which will be described later is movable in the lateral direction with respect to a lower layer member 208*j* and the support rod 208*a*.

An inner sleeve 208*e* in which a height adjustment slit 208*e*1 with a comb-shape in a side view is formed is internally fitted into the upper standing portion 208*a*3. The inner sleeve 208*e* is fitted into the upper standing portion 208*a*3 and is fixed thereto using a snap fitting or the like. The height adjustment slit 208*e*1 has an elevating guide slit 208*e*2 which extends in the axial direction and a plurality of locking slits 208*e*3 which extend forward from the elevating guide slit 208*e*2.

A locking pin 208*f*1 capable of engaging with any locking slit 208*e*3 of the height adjustment slit 208*e*1 is held on a swing lever 208*f* which will be described later. The locking pin 208*f*1 extends in the lateral direction. Pin-moving holes 208*d*1 in an elongated hole-shape which is long in the longitudinal direction in a side view are formed in left and right side walls of the inner pipe 208*d*. In the pin-moving holes 208*d*1, left and right end portions of the locking pin 208*f*1 are inserted to be movable in the longitudinal direction.

When the locking pin 208*f*1 moves to a front end of the pin-moving hole 208*d*1, it can be engaged with any locking slit 208*e*3 of the height adjustment slit 208*e*1. At this time, the elevating of the armrest body 208*b* is locked. That is, a fixed height of the armrest body 208*b* can be adjusted in multiple stages by locking the locking pin 208*f*1 to any one of the locking slits 208*e*3.

When the locking pin 208*f*1 moves to a rear end of the pin-moving hole 208*d*1, it releases the engagement with the locking slit 208*e*3 and reaches the devoting guide slit 208*e*2.

At this time, the elevating lock of the armrest body 208*b* is released, and the armrest body 208*b* can be raised and lowered (the height can be changed).

Inside the inner pipe 208*d*, a swing lever 208*f* is swingably supported via a support shaft 208*f*2 extending in the lateral direction. The swing lever 208*f* includes an upper extending portion 208*f*4 which extends above the support shaft 208*f*2 and a lower extending portion 208*f*4 which extends below the support shaft 208*f*2. An engaging pin 208*f*5 which slidably engages with a rear lower engaging groove 208*h*4 of an elevation control lever 208*h* which will be described later is provided at an upper end portion of the upper extending portion 208*f*3. A pin-holding portion 208*f*6 which holds the locking pin 208*f*1 provided at a lower end portion of the lower extending portion 208*f*4. An extension portion 208*f*7 which extends downward and a spring piece 208*f*8 which folds upward in an arc shape from a rear side of a lower end portion of the extension portion 208*f*7 are provided under the pin-holding portion 208*f*6.

A top plate 208*g* which protrudes around the inner pipe 208*d* in plan view is fixed at an upper end of the inner pipe 208*d*. The elevation control lever 208*h* is swingably supported in front of the inner pipe 208*d* in the lower surface of the lop plate 208*g* via a support shaft 208*h*1 which extends in the lateral direction. The elevation control lever 208*h* includes a front extending portion 208*h*2 which extends in front of the support shaft 208*h*1, and a rear extending portion 208*h*3 which extends behind the support shaft 208*h*1. The front extending portion 208*h*2 is provided such that a front lower portion thereof protrudes outside of an upper end portion of the elevating cylinder 208*c* such that a seated person can perform an operation of pushing it upward. The rear lower engaging groove 208*h*4 which engages with the engaging pin 208*f*5 at an upper end portion of the swing lever 208*f* is provided on a lower side of a rear end portion of the rear extending portion 208*h*3.

The swing lever 208*f* is biased such that a lower end portion thereof is displaced forward when a rear upper end of the spring piece 208*f*8 abuts against an inner wall of the inner pipe 208*d* (including an operation cable 209 passing through an inside of the inner pipe 208*d*, which will be described later) from the front. At this time, the locking pin 208*f*1 moves to the front end of the pin-moving hole 208*d*1 and is locked to any locking slit 208*e*3 of the height adjustment slit 208*e*1. When the lower end portion of the swing lever 208*f* is biased forward, the upper end portion of the swing lever 208*f* is displaced rearward, thereby displacing the rear end portion of the rear extending portion 208*h*3 of the elevation control lever 208*h* upward, so that the front extending portion 208*h*2 thus protrudes downward. When the front extending portion 208*h*2 is pushed upward, the rear end portion of the elevation control lever 208*h* displaces the upper end portion of the swing lever 208*f* forward, thereby displacing the lower end portion of the swing lever 208*f* rearward against a biasing force of the spring piece 208*f*8. Then, the locking pin 208*f*1 moves to the rear end of the pin-moving bole 208*d*1 and releases the engagement with the locking slit 208*e*3 of the height adjustment slit 208*e*1 while reaching the elevating guide slit 208*e*2, so that the armrest body 208*b* can be raised and lowered.

All end plate 208*i* having a pivot axis 208*i*1 is fixed on the top plate 208*g*. The end plate 208*i* is disposed to close an upper end opening of the elevating cylinder 208*c*. The armrest body 208*b* is supported on the end plate 208*i* to be rotatable around the pivot axis 208*i*1.

The armrest body 208*b* as the movable member includes a lower layer member 208*j* placed on the end plate 208*i* and the upper layer member 208*k* placed on the lower layer member 208*j*.

Figure 12:
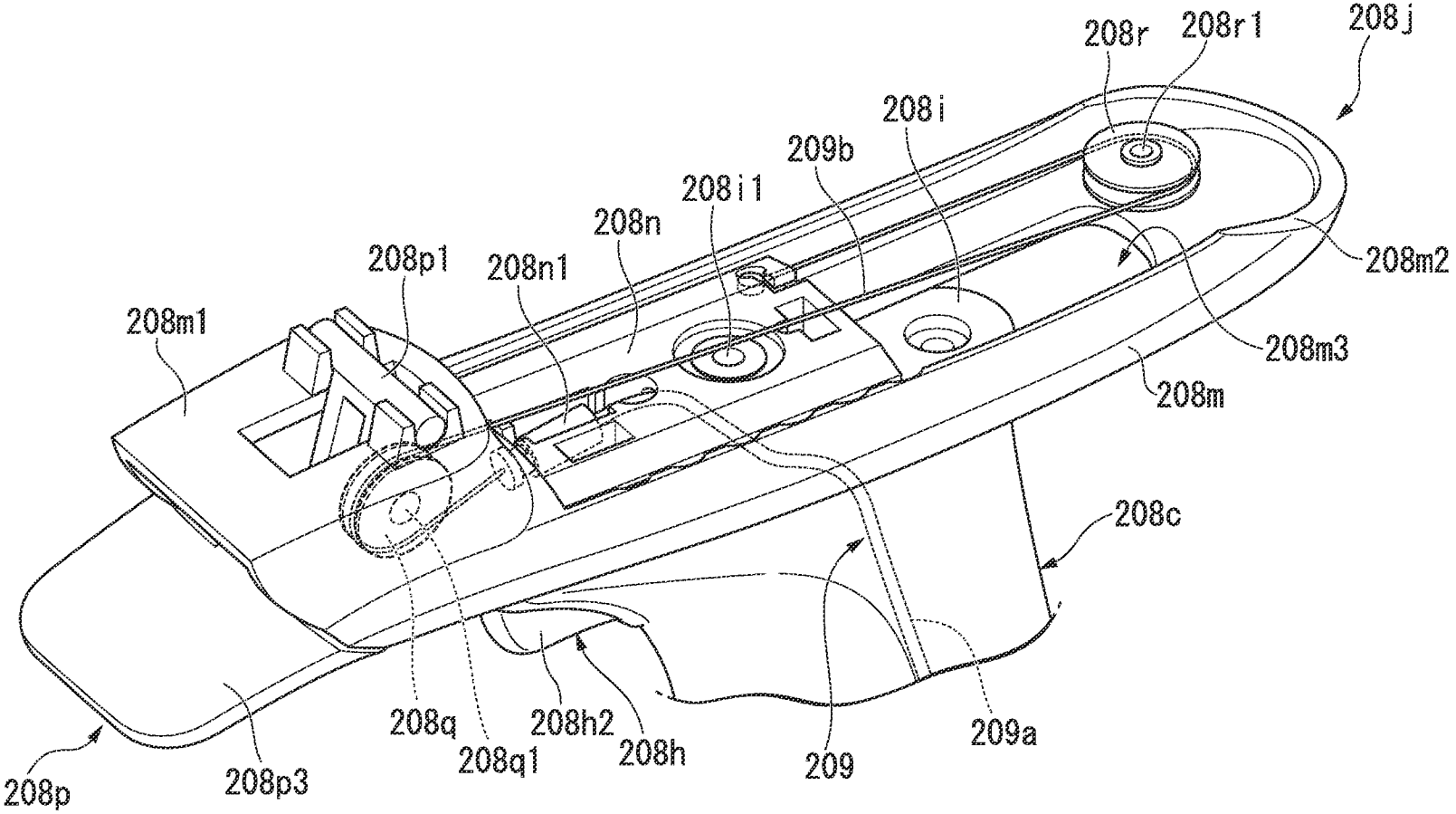
FIG. 12 is an enlarged perspective view including a lower layer member in which a cover member is omitted.

FIG. 12 is an enlarged perspective view including the lower layer member 208*j* in which a cover member 208*s* which will be described later is omitted. As shown in the figure, the lower layer member 208*j* includes: a base member 208*m* which forms an accommodating space that opens upward and is placed on the end plate 208*i* with the pivot axis 208*i*1 protruded into the accommodating space; a rotatable member 208*n* which is fitted to the base member 208*m* to be non-rotatable relative to the base member 208*m* and movable in the longitudinal direction within the accommodating space and is rotatably fitted to the pivot axis 208*i*1; an operation lever 208*p* for remotely operating devices (the elevation adjustment mechanism of the pedestal 212 and the tilt adjustment mechanism of the backrest 207) in the support base 202 via the operation cable 209; a front pulley 208*q* and a rear pulley 208*r* which wind an inner cable 209*b* of the operation cable 209 inside the lower layer member 208*j*; and a cover member 208*s* (see FIG. 11) which closes an upper open portion of the accommodating space. The lower layer member 208*j* is supported by the support rod 208*a* from below.

A front end portion of the base member 208*m* has a front step portion 208*m*1 formed therein which is changed upward in a stepped shape with respect to the accommodating space to support a front portion of the upper layer member 208*k*. A rear end portion of the base member 208*m* has a rear inclined portion 208*m*2 formed therein which is inclined downward in the rearward direction to support a rear portion of the upper layer member 208*k*. The rear inclined portion 208*m*2 is formed such that a depth of a rear end portion of the accommodating space becomes shallower toward the rearward side. An elongated hole 208*m*3 through which the pivot axis 208*i*1 parses and which extends in the longitudinal direction is formed tin a bottom wall of the base member 208*m*.

The mutable member 208*n* is formed in a flat rectangular parallelepiped shape in which the width in the vertical direction (the direction along the axial line of the pivot axis 208*i*1) is suppressed. In plan view, the rotatable member 208*n* is disposed such that front and rear surfaces thereof are aligned in the lateral direction and left and right side surfaces thereof are aligned in the longitudinal direction (the direction along left and right side walls of the base member 208*m*).

The operation lever 208*p* is formed in an L-shape in a side view. The operation lever 208*p* includes a support shaft 208*p*1 which extends in the lateral direction and is rotatably supported on the front step portion 208*m*1, a downward extending portion 208*p*2 which extends downward from the support shaft 208*p*1, and a forward extending portion 208*p*3 which extends forward from a lower end of the downward extending portion 208*p*2. The operation lever 208*p* is swingable around the support shaft 208*p*1 in a swing space inside the front step portion 208*m*1. A front portion of the forward extending portion 208*p*3 protrudes in front of a lower portion of the front step portion 208*m*1 and can be operated to be pushed up. The forward extending portion 208*p*3 is positioned below the front portion of the upper layer member 208*k*. The forward extending portion 208*p*3 is operable such that the seated person pulling his or her arm on the upper layer member 208*k* can pull it tip with a fingertip.

The front pulley 208*q* is rotatably supported at a lower end portion of the downward extending portion 208*p*2 of the operation lever 208*p* via a support shaft 208*q*1 which extends in the lateral direction. The front pulley 208*q* moves forward in accordance with a rotation of the downward extending portion 208*p*2 when the downward extending portion 208*p*2 pivots upward due to a pull-up operation of the forward extending portion 208*p*3.

The rear pulley 208*r* is rotatably supported at a rear end portion of the bottom wall of the base member 208*m* via a support shall 208*p*1 which is aligned along the vertical direction. The rear pulley 208*r* is disposed at a rear end portion of the accommodating space whose depth is reduced by the rear inclined portion 208*m*2. By disposing the rear pulley 208*r* to be laid, it is easier to arrange it even in a shallow space as compared with the case of an upright arrangement such as the front pulley 208*q*.

The operation cubic 209 includes an outer cable 209*a* and the inner cable 209*b*. The operation cable 209 extends from the support base 202 through the inner pipe 208*d* and reaches an inside of the lower layer member 208*j*.

The outer cable 209*a* of the operation cable 209 has a tip end locked to an outer cable locking portion 208*n*1 which is formed in the rotatable member 208*n*. After the inner cable 209*b* of the operation cable 209 extends forward from a front end portion of the outer cable 209*a*, the inner cable 209*b* is wound around the front pulley 208*q* from a lower side to an upper side and folds rearward. Then, the inner cable 209*b* is wound around the rear pulley 208*r* from one side to the other side in the width direction (in the figure, from an inner side to an outer side in the width direction) and folds forward. Then, a tip end portion of the inner cable 209*b* is engaged with an outer side of a rear end portion of the rotatable member 208*n* in the width direction.

In the above configuration, when the forward extending portion 208*p*3 of the operation lever 208*p* is pulled up, the front pulley 208*q* moves upward in a forward direction to draw out the inner cable 209*b*, whereby the devices in the support base 202 are operated.

Here, the front pulley 208*q* is moved in the longitudinal direction also when the armrest body 208*b* is moved in the longitudinal direction. At this time, in accordance with movement of the front pulley 208*q* back and forth in front of the front end portion of the outer cable 209*a*, the rear pulley 208*r* moves back and forth behind a front end portion of the inner cable 209*b*. For this reason, even if the length of the inner cable 209*b* in front of the front end portion of the outer cable 209*a* increase or decreases, the length of the inner cable 209*b* behind the front end portion of the inner cable 209*b* decreases or increases by the same amount. Therefore, since a change in a pull-out length of the inner cable 209*b* is suppressed, the inner cable 209*b* is prevented from being stretched when the armrest body 208*b* moves forward or the inner cable 209*b* is prevented form being loosened when the armrest body 208*b* is moved rearward.

The cover member 208*s* includes a front step cover portion 208*s*1 which is formed in a stepped shape to be aligned with the front step portion 208*m*1, a rear inclined cover portion 208*s*2 which is inclined to be aligned with the rear inclined portion 208*m*2 and extends to a forward side of the rear inclined portion 208*m*2, and an intermediate wall portion 208*s*3 which is provided apart from the upper layer member 208*k* between the front step cover portion 208*s*1 and the rear inclined cover portion 208*s*2. The front step cover portion 208*s*1 forms a front upright portion which stands upward from a front end of the intermediate wall portion 208*s*3, and the rear inclined cover portion 208*s*2 forms a rear upright portion which stands upward relatively low and gently from a rear end of the intermediate wall portion 208*s*3. A through-space 200S which passes through the armrest body 208*b* in the lateral direction is formed between the intermediate wall portion 208*s*3 and the upper layer member 208*k*. A front support portion 208*t* (a spacer member) which is formed by the front step portion 208*m*1 and the front step cover portion 208*s*1 and supports the front portion of the upper layer member 208*k* is provided in front of the through-space 200S. This front support portion 208*t* forms the through-space 200S by separating a pan of the lower layer member 208*j* from a part of the upper layer member 208*k*. The through-space 200S is formed to penetrate in the width direction of the chair 200, and can be used as a space for inserting a finger of the seated person when moving the upper layer member 208*k* in the lateral direction with respect to the lower layer member 208*j*.

The upper layer member 208*k* includes a base member 208*k*1 which is fixed on the front support portion 208*t* and the rear inclined cover portion 208*s*2 of the lower layer member 208*j*, a cover member 208*k*2 which overlaps on the base member 208*k*1 with an accommodating space therebetween, a pad member 208*k*3 which covers the cover member 208*k*2 from above, and a cushion member 208*k*4 which is interposed between the cover member 208*k*2 and the pad member 208*k*3 and is made of urethane or the like. The upper layer member 208*k* has a moderately curved shape convex upward in a side view, and its front portion is inclined downward in the forward direction and its rear portion is inclined downward in the rearward direction. The base member 208*k*1 is placed on the lower layer member 208*j* and is slidable in the lateral direction. Further, the cover member 208*k*2, the pad member 208*k*3, and the cushion member 208*k*4 are also movable in the lateral direction with respect to the lower layer member 208*j* together with the base member 208*k*1. This upper layer member 208*k* is supported by the lower layer member 208*j* from below while forming the through-space 200S between itself and a part (a central portion in the longitudinal direction) of the lower layer member 208*j*, and is disposed partially opposite to the part of the lower layer member 208*j*.

In the accommodating space of the upper layer member 208*k*, a movement-equalizing mechanism 208*u* is provided for moving the upper layer member 208*k* that is long in the longitudinal direction parallel in the lateral direction.

When the upper layer member 208*k* which is long in the longitudinal direction is moved in the lateral direction, there is a case in which the operation of grasping any of the front and rear end portions of the upper layer member 208*k* may cause tilting of the upper layer member 208*k* in plan view to obstruct a smooth lateral movement or rotating of the armrest body 208*b* about the pivot axis 208*i*1 unintentionally. On the other hand, by equalizing the lateral movement of the front and rear end portions of the upper layer member 208*k* using the movement-equalizing mechanism 208*u*, it is possible to assist the parallel movement of the upper layer member 208*k* in the lateral direction.

The movement-equalizing mechanism 208*u* includes an interlocking shaft 208*u*1 which extends in the longitudinal direction in the accommodating space of the upper layer member 208*k*, a front rack 208*u*2 and a rear rack 208*u*3 which are formed to extend in the lateral direction on the base member 208*k*1, a front bearing portion 208*u*4 which is disposed on a front side of the interlocking shaft 208*u*1, and a rear bearing portion 208*u*5 which is disposed on a rear side of the interlocking shaft 208*u*1.

A front end portion of the interlocking shaft 208*u*1 is rotatably supported by the front bearing portion 208*u*4 which is accommodated in the upper layer member 208*k* movably in the lateral direction. A rear end portion of the interlocking shaft 208*u*1 is rotatably supported by the rear bearing portion 208*u*5 which is accommodated in the upper layer member 208*k* movably in the lateral direction. A front pinion gear 208*u*6 is formed at a front portion of the interlocking shaft 208*u*1. A rear pinion gear 208*u*7 is formed at a rear portion of the interlocking shaft 208*u*1. The front pinion gear 208*u*6 is engaged with the front rack 208*u*2. The rear pinion gear 208*u*7 is engaged with the rear rack 208*u*3. The front bearing portion 208*u*4 and the rear bearing portion 208*u*5 are fixed to the lower layer member 208*j* and are fixed thereto even when the upper layer member 208*k* moves.

A guide protruding portion 208*v*1 whose tip is directed downward is provided at a front end of the front bearing portion 208*u*4. A guide groove portion 208*v*2 formed in the lateral direction (the moving direction of the upper layer member 208*k*) is provided on a front upper surface of the base member 208*k*1. The guide protruding portion 208*v*1 is slidably engaged with the guide groove portion 208*v*2. The guide protruding portion 208*v*1 and the guide groove portion 208*v*2 form a front guide portion 208*v* (a guide element).

A guide protruding portion 208*w*1 whose tip is directed downward is provided at a rear end of the rear bearing portion 208*u*5. A guide groove portion 208*w*2 formed along the lateral direction (the moving direction of the upper layer member 208*k*) is provided on a rear upper surface of the base member 208*k*1. The guide protruding portion 208*w*1 is slidably engaged with the guide groove portion 208*w*2. The guide protruding portion 208*w*1 and the guide groove portion 208*w*2 form a rear guide portion 208*w* (a guide element).

If the front end portion or the rear end portion of the upper layer member 208*k* is grasped and the upper layer member 208*k* is attempted to be moved in the lateral direction in the above configuration, the rack (the front rack 208*u*2 or the rear rack 208*u*3) moves and the pinion gear (the front pinion gear 208*u*6 or the rear pinion gear 208*u*7) at the end portion on the side (the driving side) among the front and rear end portions of the upper layer member 208*k* which is gripped by the seated person rotates. As a result, the interlocking shaft 208*u*1 rotates and the side (the driven side) opposite to the upper layer member 208*k* separated by the length of the interlocking shaft 208*u*1 is moved in the lateral direction by the pinion gear and the rack at the end portion of the side opposite thereto by the same amount as the end portion on the driving side is moved. Thus, the parallel movement of the upper layer member 208*k* in the lateral direction is promoted.

The chair 200 and the armrest 208 of the second embodiment as described above includes the support rod 208*a*, the lower layer member 208*j* which is supported by the support rod 208*a* from below, and the upper layer member 208*k* which is supported by the lower layer member 208*j* from below to be movable in the horizontal direction. The through-space 200S (a finger-inserting space) which is a guide portion is formed between at least a part of the lower layer member 208*j* and the upper layer member 208*j*.

For this reason, it is possible for the seated person of the chair 200 to insert his or her finger into the through-space 200S and grasp the upper layer member 208*k* to move it in the horizontal direction. In this case, since the seated person can hold the upper layer member 208*k* from above and below, for example, by bringing a palm of the seated person's hand into contact with an upper surface of the upper layer member 208*k* and inserting fingertips into the through-space 200S, the seated person can stably hold the upper layer member 208*k*. Therefore, according to the chair 200 and the armrest 208 of the second embodiment, the upper layer member 208*k* can be moved in a very stable state as compared with the case where the through-space 200S is not provided.

In addition, according to the chair 200 and the armrest 208, the upper layer member 208*k* can be stably moved even if the side surface of the upper layer member 208*k* is not widened. For this reason, it is also possible to make the upper layer member 208*k* in a thin shape. This makes it possible to increase the degree of freedom of the armrest design.

Also, the chair 200 and the armrest 208 of the second embodiment include the front support portion 208*t* which functions as a spacer member that forms the through-space 200S by separating a part of the lower layer member 208*j* from a part of the upper layer member 208*k*. The pan of the lower layer member 208*j* is separated away from the part of the upper layer member 208*k* by the front support portion 208*t*, and the space thus formed is defined as the through-space 200S.

This front support portion 208*t* makes it possible to easily secure the through-space 200S. In addition, due to the presence of the front support portion 208*t*, the seated person can also find the position of the through-space 200S using the front support portion 208*t* as a mark, so that the seated person can easily find the position of the through-space 200S.

Further, the chair 200 and the armrest 208 of the second embodiment include the front guide portion 208*v* and the rear guide portion 208*w* as guide elements which guide the movement of the upper layer member 208*k* in the lateral direction with respect to the lower layer member 208*j*. Also, the front guide portion 208*v* and rear guide portion 208*w* include guide grooves (the guide groove portion 208*v*1 and the guide groove portion 208*w*2) which are provided in the base member 208*k*1 and are formed in the moving direction of the upper layer member 208*k*, and guide protruding portions (the guide protruding portion 208*v*1 and the guide protruding portion 208*w*1) which are fixed to the lower layer member 208*j* and are slidably engaged with the guide grooves. Thus, since the movement of the upper layer member 208*k* relative to the lower layer member 208*j* is guided by sliding the guide protruding portions along the guide grooves, the upper layer member 208*k* can be stably moved in the lateral direction.

Furthermore, in the chair 200 and the armrest 208 of the second embodiment, the through-space 200S penetrates from one side to the other side of the armrest 208 in the width direction of the chair 200. Therefore, the seated person can insert fingers into the through-space 200S from both sides of the armrest 208 in the width direction. For example, since the thumb of the seated person can be inserted into the through-space 200S from one side of the armrest 208 in the width direction, and fingers other than the thumb of the seated person can be inserted into the through-space 200S from the other side of the armrest 208 in the width direction, it is possible to hold the upper layer member 208*k* more stably. Moreover, since there is no member that prevents the fingers from being inserted into the through-space 200S, the fingers of the seated person can be inserted deeply into the through-space 200S, thereby making it possible to hold the upper layer member 208*k* more stably.

Although the preferred embodiments of the present invention have been described with reference to the accompanying drawings, the present invention is not limited to the second embodiment described above. The shapes and combinations of the constituent members shown in the second embodiment are examples, and can be variously modified based on the design requirements in the range without departing from the object of the present invention.

Figure 13A:
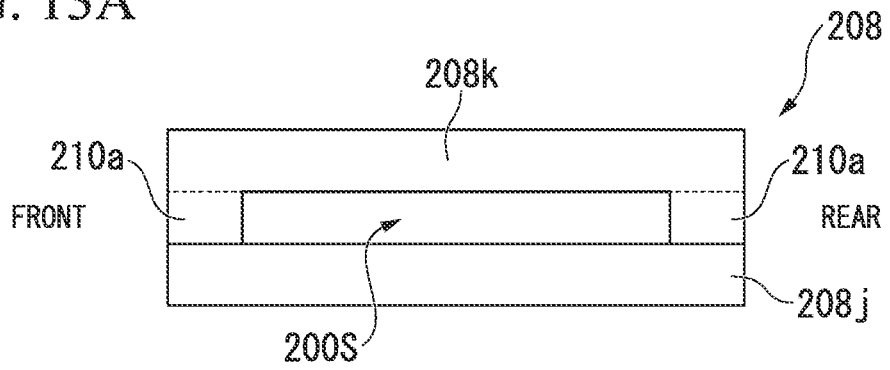
FIG. 13A is a schematic diagram showing a third modification of the armrest.
Figure 13B:
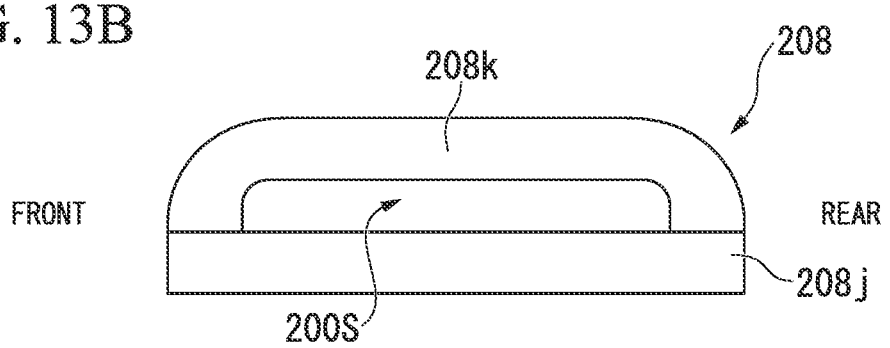
FIG. 13B is a schematic view showing a fourth modification of the armrest.

FIGS. 13A to 13D are schematic views showing a third modification to a sixth modification of the present invention. In the second embodiment, the through-space 200S is secured by the single front support portion 208*t*. However, the present invention is not limited thereto. As a third modification of the present invention, as shown in FIG. 13A, it is also possible to provide two spacer members 210*a* which are separated away from each other in the longitudinal direction and secure the through-space 200S using the plurality of spacer members 210*a*. Also, as a fourth modification of the present invention, as shown in FIG. 13B, the upper layer member 208*k* may be curved in an arc shape to secure the through-space 200S instead of providing the spacer member. Also, in the present invention, the spacer member can be provided as a part of the lower layer member 208*j* or the upper layer member 208*k*, and it may also be provided separately from the lower layer member 208*j* and the upper layer member 208*k*.

Figure 13C:
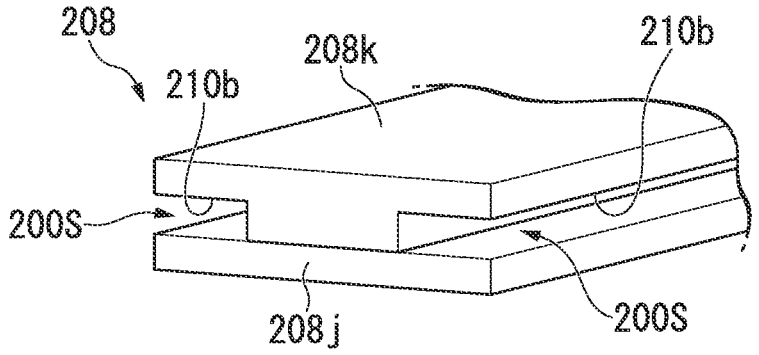
FIG. 13C is a schematic view showing a fifth modification of the armrest.

In addition, in the second embodiment, the configuration in which the through-space 200S is provided as the finger-inserting space of the present invention has been described. However, the present invention is not limited thereto. For example, as a fifth modification of the present invention, as shown in FIG. 13C, recessed portions 210*b* may be formed on both side portions of the upper layer member 208*k* in the lateral direction and the finger-inserting space may be formed between the lower layer member 208*j* and the upper layer member 208*k* by the recessed portions 210*b*.

Figure 13D:
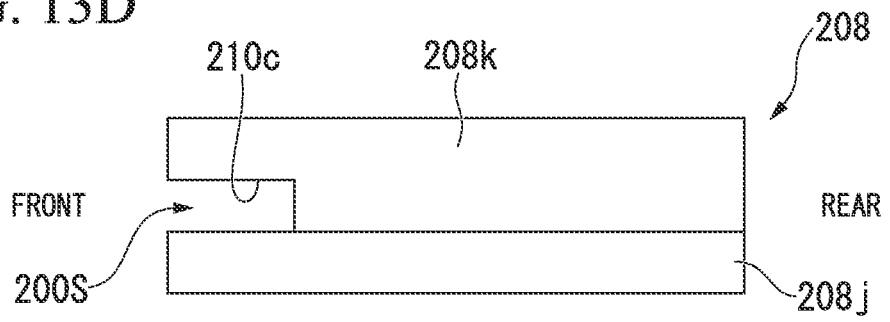
FIG. 13D is a schematic view showing a sixth modification of the armrest.

Further, as a sixth modification of the present invention, as shown in FIG. 13D, a recessed portion 210*c* may be formed at the front end portion of the upper layer member 208*k* and the finger-inserting space may be formed between the lower layer member 208*j* and the upper layer member 208*k* by the recessed portion 210*c*.

It is also possible to form the recessed portions 210*b* and 210*c* on the lower layer member 208*j* side.

Also, in the second embodiment, the guide grooves (the guide groove portion 208*v*2 and the guide groove portion 208*w*2) of the front guide portion 208*v* and the rear guide portion 208*w* are provided on the base member 208*k*1, and the guide protruding portions (the guide protruding portion 208*v*1 and the guide protruding portion 208*w*1) are fixed to the lower layer member 208*j*. However, the present invention is not limited thereto, and the guide grooves (the guide groove portion 208*v*2 and the guide groove portion 208*w*2) may be fixed to the lower layer member 208*j* and the guide protruding portions (the guide protruding portion 208*v*1 and the guide protruding portion 208*w*1) may be provided on the base member 208*k*1.

INDUSTRIAL APPLICABILITY

According to the armrest and the chair of the present invention, it is possible to prevent the seated person from moving the movable member in a state where the seated person touches an unexpected portion, thereby making it possible to suppress an uncomfortable feeling given to the seated person when a fingertip or the like of the seated person touches an unexpected portion in the case of moving the movable member.

In addition, according to the armrest and the chair of the present invention, it is possible to move the upper layer member in an extremely stable state and to improve the operability in moving the upper layer member in the armrest in which the upper layer member can be movable in the horizontal direction with respect to the lower layer member.

DESCRIPTION OF REFERENCE SIGNS

100, 200 Chair
8, 208 Armrest
8*a*, 208*a* Support rod (support member)
8*j*, 208*j* Lower layer member
8*k*, 208*k* Upper layer member
S, 200S Through-space (guide portion/finger-inserting space)
208*t* Front support portion (spacer member)
208*k*1 Base member
208*v* Front guide portion (guide element)
208*w* Rear guide portion (guide element)

The invention claimed is:

1. An armrest for being provided on a chair, the armrest comprising:
- a support member;
- a movable member which includes a placing surface for supporting a limb of a seated person and is supported by the support member from below to be movable in a horizontal direction; and
- a guide portion which indicates a position where the seated person touches when moving the movable member, wherein
- the movable member includes an upper layer member and a lower layer member,
- the lower layer member is supported by the support member from below,
- the upper layer member is supported by the lower layer member from below to be movable in a horizontal direction, forms a finger-inserting space between itself and at least a part of the lower layer member, and is disposed at least partially facing the part of the lower layer member,
- the armrest comprises a spacer member which separates a part of the lower layer member from a part of the upper layer member to form the finger-inserting space,
- the lower layer member includes a base member, and
- the spacer member is formed by a front step portion formed on a front end portion of the base member to support a front portion of the upper layer member and is provided in front of the finger-inserting space.

2. The armrest according to claim 1, comprising:
- a guide element which guides movement of the upper layer member in the horizontal direction with respect to the lower layer member, wherein
- the guide element includes:
- a guide groove which is provided on either one of the upper layer member and the lower layer member and is formed in a moving direction of the upper layer member; and
- a guide protruding portion which is provided on the other of the upper layer member and the lower layer member and is slidably engaged with the guide groove.

3. The armrest according to claim 1, wherein
- the finger-inserting space penetrates from one side to the other side of the armrest in a width direction of the chair.

4. The armrest according to claim 1, wherein
- the base member forms an accommodating space opening upward,
- the lower layer member includes
  - a rotatable member which is fitted to the base member to be non-rotatable relative to the base member and is movable in a longitudinal direction of the chair within the accommodating space, and a cover member which closes an upper open portion of the accommodating space, and the cover member includes a front step cover portion which is formed in a stepped shape to be aligned with the front step portion.

5. The armrest according to claim 4, wherein the spacer member is formed by the front step portion and the front step cover portion.

6. The armrest according to claim 5, wherein the front step portion is changed upward in a stepped shape with respect to the accommodating space.

7. The armrest according to claim 4, wherein the front step portion is changed upward in a stepped shape with respect to the accommodating space.

8. A chair comprising the armrest according to claim 1.

* * * * *